US005089381A

United States Patent [19]

Becker et al.

[11] Patent Number: 5,089,381

[45] Date of Patent: Feb. 18, 1992

[54] SILVER HALIDE RECORDING MATERIAL

[75] Inventors: Manfred Becker, Leverkusen; Hans Öhlschläger, Bergisch Gladbach, both of Fed. Rep. of Germany

[73] Assignee: Agfa-Gevaert AG, Leverkusen, Fed. Rep. of Germany

[21] Appl. No.: 664,482

[22] Filed: Mar. 4, 1991

Related U.S. Application Data

[63] Continuation of Ser. No. 435,565, Nov. 13, 1989, abandoned.

[30] Foreign Application Priority Data

Nov. 15, 1988 [DE] Fed. Rep. of Germany ..... 3838634

[51] Int. Cl.[5] ..... G03C 1/34

[52] U.S. Cl. ..... 430/611; 430/613

[58] Field of Search ..... 430/611, 613

[56] References Cited

U.S. PATENT DOCUMENTS

| | | | |
|---|---|---|---|
| 2,955,036 | 10/1960 | Dersch et al. | 96/66 |
| 4,243,748 | 1/1981 | Elsner et al. | 430/600 |
| 4,276,374 | 6/1981 | Mifune et al. | 430/611 |
| 4,314,024 | 2/1982 | Gernert | 430/564 |
| 4,514,492 | 4/1985 | LeStrange et al. | 430/600 |
| 4,657,847 | 4/1987 | Ikeda et al. | 430/523 |
| 4,784,938 | 11/1988 | Obhayashi et al. | 430/505 |
| 4,906,557 | 3/1990 | Becker et al. | 430/543 |
| 4,910,129 | 3/1990 | Takahashi et al. | 430/573 |

FOREIGN PATENT DOCUMENTS

| | | |
|---|---|---|
| 295507 | 12/1988 | European Pat. Off. . |
| 3605713 | 8/1987 | Fed. Rep. of Germany . |
| 63-046445 | 2/1988 | Japan . |

OTHER PUBLICATIONS

Research Disclosure, vol. 22-31, No. 17643 (Dec. 1978), Industrial Opportunities, Havent, Hampshire, Gr. Br.

*Primary Examiner*—Charles L. Bowers, Jr.
*Assistant Examiner*—Janis L. Dote
*Attorney, Agent, or Firm*—Connolly and Hutz

[57] ABSTRACT

A photosensitive silver halide material comprising a support and at least one photosensitive silver halide emulsion layer, of which the emulsion contains an effective quantity of at least one compound from each of at least two classes A, B, C and D defined hereinafter:

A) compounds corresponding to general formula I (I)

B) compounds corresponding to general formula II (II)

or tautomers thereof,

C) compounds corresponding to general formula (III)

(III)

D) compounds corresponding to general formula IV (IV)

in which $R_1$–$R_3$, $R_{11}$–$R_{19}$, Y, Z, m and n are as defined in the specification, are distinguished by effective latent image stabilization for a minimum increase in fogging and loss of sensitivity.

3 Claims, No Drawings

SILVER HALIDE RECORDING MATERIAL

This application is a continuation of the applicants' co-pending application Ser. No. 435,565, filed Nov. 13, 1989, abandoned.

This invention relates to a silver halide recording material having improved latent image stabilization.

When a photographic silver halide material is exposed, a latent image is initially formed, being developed during development by the developer to form the visible silver image. There are often prolonged periods between exposure and development in which the latent image is degraded again, resulting in unsatisfactory photographs.

For this reason, so-called latent image stabilizers are added to the photographic materials with a view to preventing degradation of the latent image over prolonged periods.

Examples of compounds which are said to act as latent image stabilizers can be found, for example, in GB 1,308, 777, DE 2 325 039, 2 335 093, 2 304 322, 3 308 203, JA 50/94918, 57/100 424, JP 116 167, GB 1,458,197 and U.S. Pat. Nos. 4,334,014 and 4,378,426.

The known compounds which, when added to photographic emulsions, are supposed to stabilize their latent image are attended by the disadvantage that, depending on the quantity added per mol silver halide (and on the pH and pAg of the emulsion layer), they either slow down degradation of the latent image to only an inadequate extent during storage of the exposed emulsion or, although satisfactorily stabilizing the latent image, cause increased fogging of the photographic emulsion in storage.

It is known that antifogging agents, including for example 5-methyl benztriazole, 1-phenyl-5-mercaptotetrazole, 2,5-dimercapto-1,3,4-thiadiazole, etc., may be added to the emulsions in addition to the latent image stabilizers mentioned above. Antifogging agents such as these are capable of inhibiting the increase in fogging during storage caused by the latent image stabilizers without at the same time affecting stabilization of the latent image.

However, this method of latent image stabilization is attended by the disadvantage that the antifogging agents have to be added in quantities which distinctly reduce the sensitivity of the emulsion.

Accordingly, the object of the present invention is to provide ways of effectively stabilizing the latent image while, at the same time, minimizing increases in fogging and losses of sensitivity.

According to the invention, this object is achieved by adding at least one compound from each of at least two different classes defined hereinafter to the silver halide emulsions of the photographic material.

Accordingly, the present invention relates to a photosensitive silver halide material comprising a support and at least one photosensitive silver halide emulsion layer, of which the emulsion contains $10^{-5}$ to $10^{-2}$ mol per mol of silver halide of a compound of class A, $10^{-5}$ to $10^{-2}$ mol per mol of silver halide of a compound of class B, and $10^{-6}$ to $10^{-3}$ mol per mol of silver halide of one compound selected from the group consisting of classes C and D, wherein the classes A, B, C and D are defined hereinafter:

A) compounds corresponding to general formula I

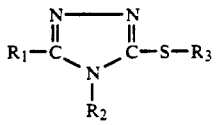

(I)

in which $R_1$ is hydrogen; alkyl containing up to 9 carbon atoms which may be substituted, for example, by chlorine, bromine, fluorine, cyano, hydrogen, alkoxy, such as methoxy, alkylthio, carboxy, alkoxycarbonyl, carbonamido; aryl, such as phenyl; aralkyl, such as benzyl; cycloalkyl, such as cyclohexyl; or a heterocycle, such as furyl, thienyl, pyridyl;

$R_2$ represents hydrogen; alkyl which may be substituted or unsubstituted; alkenyl, such as allyl; aryl, such as phenyl; or $—NR_4R_5$;

$R_3$ represents hydrogen or a group releasable during development, such as $—COR_9$ or $COOR_{10}$;

$R_4$ and $R_5$ have the same meaning as $R_1$ or represent $—COR_6$, $—CONHR_7$ or $—COOR_8$;

$R_6$ represents alkyl or cycloalkyl containing up to 8 carbon atoms, which may be substituted or unsubstituted, for example methyl, butyl, cyclohexyl, methoxymethyl and methyl mercaptomethyl; allyl; benzyl; aryl, such as phenyl, 4-chlorophenyl, 4-sulfophenyl;

$R_7$ represents hydrogen or $R_6$;

$R_8$, $R_9$ and $R_{10}$ represent alkyl or cycloalkyl, which may be substituted or unsubstituted, containing up to 8 carbon atoms, such as methyl, ethyl and isopropyl; aryl, such as phenyl;

B) compounds corresponding to general formula II

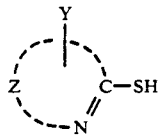

(II)

or tautomers thereof, in which

Z represents the atoms required to complete an oxazole or oxazine ring and

Y represents a fused aromatic ring system comprising at least one aromatic ring substituted by at least one acidic group;

C) compounds corresponding to general formula (III)

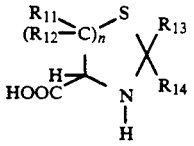

(III)

in which $R_{11}$ and $R_{12}$ may be the same or different and represent hydrogen, $C_{1-3}$ alkyl, such as methyl and ethyl;

$R_{13}$ and $R_{14}$ may be the same or different and represent hydrogen, $C_{1-6}$ alkyl, such as methyl and ethyl; cycloalkyl, such as cyclohexyl; aryl, such as phenyl; a heterocycle, such as furyl or thienyl; carboxyl or carbonamido and n=1 or 2; and D) compounds corresponding to general formula IV

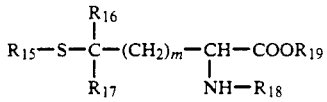

(IV)

in which $R_{15}$ represents hydrogen, $C_{1-8}$ alkyl, which may be substituted or unsubstituted, such as methyl, ethyl, isopropyl, methoxymethyl, chloroethyl, cyanoethyl, methyl thiomethyl and carboxymethyl; allyl; benzyl; a group corresponding to the formulae $-COR_{20}$, $-COOR_{21}$ or

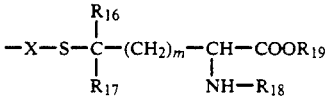

$R_{16}$ and $R_{17}$ represent hydrogen or $C_{1-3}$ alkyl, $R_{18}$ represents hydrogen, $-COR_{22}$, $-CONHR_{23}$, $R_{19}$ represents hydrogen, $C_{1-10}$ alkyl, $R_{20}$, $R_{21}$ and $R_{22}$ represent alkyl or cycloalkyl containing up to 8 carbon atoms, which may be substituted, such as methyl, ethyl, cyclohexyl or benzyl; allyl; aryl, such as phenyl, $R_{23}$ is hydrogen or $R_{20}$, X is a direct bond or alkylene containing up to 6 carbon atoms and m=0 or 1.

The following substituent definitions and formulae apply to preferred compounds A, B, C and D:

$R_1$ hydrogen, $C_{1-9}$ alkyl, unsubstituted or substituted by $C_{1-4}$ alkoxy, carboxy, hydroxy, halogen, $C_{1-4}$ alkoxycarbonyl, $C_{1-4}$ alkyl carbonyloxy or phenoxy; phenyl unsubstituted or substituted by $C_{1-4}$ alkyl, $C_{1-4}$ alkoxy or halogen; cyclohexyl, benzyl, pyridyl or furyl, $R_2$ hydrogen, $C_{1-4}$ alkyl optionally substituted by carboxy, $C_{1-4}$ alkoxycarbonyl or 1-piperidino; allyl, phenyl or $-NR_4R_5$, $R_3$ hydrogen, $C_{1-4}$ alkylcarbonyl or $C_{1-6}$ alkoxycarbonyl, $R_4$ hydrogen, $C_{1-4}$ alkylcarbonyl, hydroxyethyl, $C_{1-4}$ alkylaminocarbonyl, cyclohexylaminocarbonyl, sulfophenyl, sulfophenylcarbonyl, methyl thioacetyl or $C_{1-4}$ alkoxycarbonyl, $R_5$ hydrogen, $C_{1-4}$ alkylcarbonyl or $C_{1-4}$ alkoxycarbonyl;

for B, formula V

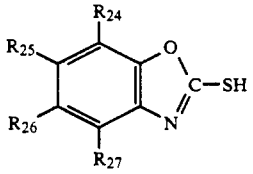

(V)

in which $R_{24}$ to $R_{27}$ may be the same or different and represent hydrogen or alkyl, particularly $C_{1-4}$ alkyl; two of the substituents $R_{24}$ to $R_{27}$ together may represent the atoms required to complete a ring, more especially a fused phenyl ring, with the proviso that at least one of the substituents $R_{24}$ to $R_{27}$ contains an acidic substituent or is an acidic substituent;

$R_{11}$ and $R_{12}$ independently of one another represent hydrogen or methyl, $R_{13}$ represents hydrogen or methyl, $R_{14}$ represents hydrogen, methyl, furyl, methyl furyl, thienyl, bromothienyl, cyclohexyl, phenyl, carboxy or aminocarbonyl, n=1 or 2, $R_{15}$ represents hydrogen, $C_{1-4}$ alkyl, carboxy-$C_{1-4}$-alkyl, allyl, $C_{1-4}$ alkoxycarbonyl, benzyl or

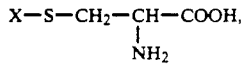

$R_{16}$ represents hydrogen, $R_{17}$ represents hydrogen or methyl, $R_{18}$ represents $C_{1-4}$ alkylcarbonyl, aminocarbonyl, $R_{19}$ represents hydrogen or $C_{1-10}$ alkyl, X represents a direct bond or $C_{2-4}$ alkylene and m=0 or 1.

The following are examples of compounds corresponding to formula I

| No. | $R_1$ | $R_2$ | $R_3$ |
|---|---|---|---|
| A-1 | methyl | methyl | hydrogen |
| A-2 | methyl | phenyl | hydrogen |
| A-3 | methyl | allyl | hydrogen |
| A-4 | hydrogen | allyl | hydrogen |
| A-5 | ethyl | allyl | hydrogen |
| A-6 | benzyl | phenyl | hydrogen |
| A-7 | phenoxymethyl | phenyl | hydrogen |
| A-8 | 2-pyridyl | hydrogen | hydrogen |
| A-9 | 4-pyridyl | methyl | hydrogen |
| A-10 | trifluoromethyl | methyl | hydrogen |
| A-11 | tert.-butyl | methyl | hydrogen |
| A-12 | 2-furyl | hydrogen | hydrogen |
| A-13 | methyl | ethyoxycarbonyl-methyl | hydrogen |
| A-14 | phenyl | ethoxycarbonyl-methyl | hydrogen |
| A-15 | ethoxycarbonyl-methyl | hydrogen | hydrogen |
| A-16 | carboxymethyl | hydrogen | hydrogen |
| A-17 | methyl | 1-piperidino-carbonylmethyl | hydrogen |
| A-18 | methyl | carboxymethyl | hydrogen |
| A-19 | 2-furyl | methyl | hydrogen |
| A-20 | methyl | diacetylamino | acetyl |
| A-21 | hydroxymethyl | methyl | hydrogen |
| A-22 | methylcarbonyl-oxymethyl | methyl | hydrogen |
| A-23 | ethoxymethyl | methyl | hydrogen |
| A-24 | ethyl | amino | hydrogen |
| A-25 | hydrogen | methylureido | hydrogen |
| A-26 | hydrogen | acetylamino | hydrogen |
| A-27 | methyl | acetylamino | hydrogen |
| A-28 | methyl | 2-hydroxyethyl-amino | hydrogen |
| A-29 | phenyl | 2-hydroxyethyl-amino | hydrogen |
| A-30 | hydrogen | cyclohexylureido | hydrogen |
| A-31 | benzyl | amino | hydrogen |
| A-32 | 4-chlorophenyl | amino | hydrogen |
| A-33 | methyl | 4-sulfonanilino | hydrogen |
| A-34 | methyl | amino | hydrogen |
| A-35 | hydrogen | 2-sulfophenyl-carbonylamino | hydrogen |
| A-36 | methyl | methylmercapto-acetylamino | hydrogen |
| A-37 | hydroxymethyl | amino | hydrogen |
| A-38 | methyl | acetylamino | acetyl |
| A-39 | cyclohexyl | amino | hydrogen |
| A-40 | methyl | N-acetyl-N-ethoxy-carbonylamino | ethoxy-carbonyl |
| A-41 | methyl | N-acetyl-N-butoxy- | butoxy- |

-continued

| No. | $R_1$ | $R_2$ | $R_3$ |
|---|---|---|---|
| A-42 | hydrogen | carbonylamino butoxycarbonyl-amino | carbonyl butoxy-carbonyl |
| A-43 | hydrogen | diethoxycarbonyl-amino | ethoxy-carbonyl |

Heterocyclic systems corresponding to formula II are, for example, benzoxazole, naphth[1,2:d]oxazole, naphth[2,3:d]oxazole, naphth[2,1:d]oxazole, oxazine, naphth[1,8:de]oxazine. The oxazole or oxazine rings contain substituents containing acidic groups or fused aromatic rings preferably containing acidic groups attached thereto. Examples of acidic groups are —COOH, —$SO_3H$ and sulfonamido groups which may in turn be substituted by alkyl, aralkyl or aryl radicals.

The compounds corresponding to formula II may be further substituted by halogen atoms, alkyl, ether and ester groups.

The following are examples of compounds corresponding to formulae II and V:

B-1: 2-mercapto-8-sulfonaphth[1,2-d]oxazole
B-2: 2-mercapto-7-sulfonaphth[2,3-d]oxazole
B-3: 2-mercapto-5-sulfonaphth[2,1-d]oxazole
B-4: 2-mercapto-6-sulfonaphth[1,2-d]oxazole
B-5: 2-mercapto-8-sulfonaphth[1,8-de]axazole
B-6: 2-mercapto-5,8-disulfonaphth[1,8-de]oxazole
B-7: 2-mercapto-5,7-disulfonaphth[2,3-d]oxazole
B-8: 2-mercapto-5-chloro-7-sulfobenzoxazole
B-9: 2-mercapto-5-sulfobenzoxazole
B-10: 2-mercapto-5-sulfo-7-chlorobenzoxazole
B-11: 2-mercapto-5-carboxybenzoxazole
B-12: 2-mercapto-7-carboxybenzoxazole
B-13: 2-mercapto-5-aminosulfonylbenzoxazole
B-14: 2-mercapto=7-aminosulfonylbenzoxazole
B-15: 2-mercapto-5-methyl-7-sulfobenzoxazole
B-16: 2-mercapto-5-(sulfophenyl)-oxazole
B-17: 2-mercapto-4-(sulfophenyl)-oxazole
B-18: 2-mercapto-4,5-di-(sulfophenyl)-oxazole The following are examples of compounds corresponding to formula III:

C-1: 4-carboxythiazolidine
C-2: 4-carboxy-5,5-dimethylthiazolidine
C-3: 2,2-dimethyl-4-carboxythiazolidine
C-4: 2-(2-furyl)-4-carboxythiazolidine
C-5: 2-(2-thienyl)-4-carboxythiazolidine
C-6: 2-cyclohexyl-4-carboxythiazolidine
C-7: 2-(2-thienyl)-4-carboxy-5,5-dimethylthiazolidine
C-8: 2-(5-methylfuryl-2)-4-carboxythiazolidine
C-9: 2-(5-bromothienyl-2)-4-carboxythiazolidine
C-10: 2-phenyl-4-carboxythiazolidine
C-11: 3-aza-4-carboxythiane, hydrochloride
C-12: 2-methyl-2,4-dicarboxythiazolidine
C-13: 2-methyl-2-aminocarbonyl-4-carboxythiazolidine
C-14: 2-(3-thienyl)-4-carboxythiazolidine The following are examples of compounds corresponding to formula IV:

D-1: cysteine
D-2: 2-amino-4-mercaptobutyric acid
D-3: S-methyl cysteine
D-4: cysteine octyl ester hydrochloride
D-5: n-aminocarbonyl cysteine
D-6: S-carboxymethyl cysteine
D-7: S-(2-carboxyethyl)-cysteine
D-8: S-ethyl cysteine
D-9: N-anilinocarboxyl cysteine
D-10: S-allyl cysteine
D-11: 2-amino-3-methyl-3-mercaptobutyric acid
D-12: N-acetyl cysteine
D-13: cysteine methyl ester hydrochloride
D-14: N-amidinocysteine
D-15: N-benzoyl cysteine
D-16: methionine
D-17: N-acetyl-S-methyl cysteine
D-18: N-acetyl-S-methyl-cysteine methyl ester
D-19: S-methoxycarbonyl cysteine
D-20: S-benzyl cysteine
D-21: cystine
D-22: di-s-cysteino-1,2-ethane
D-23: di-s-cysteino-1,3-propane It is favorable to add the compounds according to the invention in the form of solutions. Suitable solvents are, for example, lower alcohols, tetrahydrofuran, N-methyl pyrrolidone or acetone where the compounds according to the invention are insoluble in water. The compounds of classes A and B to be used in accordance with the invention are preferably used in quantities of $10^{-5}$ to $10^{-2}$ mol and more preferably in quantities of $3.10^{-5}$ to $10^{-3}$ mol per mol silver halide while the compounds of classes C and D are preferably used in quantities of $10^{-6}$ to $10^{-3}$ mol and more preferably in quantities of $3.10^{-6}$ to $3.10^{-4}$ mol per mol silver halide.

The emulsions may contain other antifogging agents and stabilizers in combination with the stabilizers according to the invention. Azaindenes, preferably tetra- or penta-azaindenes, especially those substituted by hydroxyl or amino groups, are particularly suitable. Compounds such as these are described, for example, in the Article by Birr in Z. Wiss. Phot. 47, (1952), pages 2–58.

Other stabilizers and antifogging agents of the type described in the journal Research Disclosure No. 17643 of December, 1978, Chapter VI, published by Industrial Opportunities Ltd., Homewell Havant, Hampshire, P09 1 EF, Great Britain, may be added providing they do not interfere with the effect according to the invention of the compounds of classes A, B, C and D.

The silver halide recording material according to the invention may be a black-and-white material or a color photographic material.

Examples of color photographic materials are color negative films, color reversal films, color positive films, color photographic paper, color reversal photographic paper, dye-sensitive materials for the dye diffusion transfer process or the silver dye bleaching process.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

The color photographic materials normally contain at least one red-sensitive, at least one green-sensitive and at least one blue-sensitive silver halide emulsion layer and, optionally, intermediate layers and protective layers.

Binder, silver halide grains and color couplers are essential constituents of the photographic emulsion layers.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose and phthalyl cellulose and also qelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine). Gelatines of high viscosity and low swelling are particularly advantageous.

The silver halide present as photosensitive constituent in the photographic material may contain as halide chloride, bromide or iodide and mixtures thereof. For example, 0 to 15 mol-% of the halide of at least one layer may consist of iodide, 0 to 100 mol-% of chloride and 0 to 100 mol-% of bromide. Silver bromide iodide emulsions are normally used in the case of color negative and color reversal films while silver chloride bromide emulsions of high chloride content up to pure silver chloride emulsions are normally used in the case of color negative and color reversal paper. The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 5:1, the diameter of a crystal being defined as the diameter of a circle with an area corresponding to the projected area of the crystal. However, the layers may also contain platy silver halide crystals in which the diameter-to-thickness ratio is considerably greater than 5:1, for example from 12:1 to 30:1.

The silver halide grains may also have a multiple-layer grain structure, in the most .simple case with an inner and an outer core region (core/shell), the halide composition and/or other modifications such as, for example, doping of the individual grain regions, being different. The average grain size of the emulsions is preferably between 0.2 μm and 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al, Making and Coating Photographic Emulsion, The Focal Press, London (1966)).

Precipitation of the silver halide is preferably carried out in the presence of the binder, for example gelatine, and may be carried out in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which new nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Salts or complexes of metals, such as Cd, Zn, Pb, Tl, Bi, Ir, Rh, Fe, may be present during the precipitation and/or physical ripening of the silver halide grains.

In addition, precipitation may even be carried out in the presence of sensitizing dyes. Complexing agents and/or dyes may be inactivated at any time, for example by changing the pH value or by an oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizer concentration) until sensitivity and fogging are both optimal. The process is described, for example, in H. Frieser "Die Grundlagen der Photographischen Prozesse mit Silberhalogeniden", pages 675-734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964, and in Ullmanns Encyclopädie der technischen Chemie, 4th Edition, Vol. 18, pages 431 et seq and Research Disclosure no. 17643, Section III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfur or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643/1978, Section IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia- or selenocarbocyanines and 9-ethyl naphthothiaoxa- and benzimidazocarbocyanines, providing the dye contains at least one sulfoalkyl group at the heterocyclic nitrogen;

2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

The following red sensitizers RS, green sensitizers GS and blue sensitizers BS, which may be used individually or in combination with one another, for example RS 1 and RS 2 and also GS 1 and GS 2, are mentioned as examples, particularly for negative and reversal film.

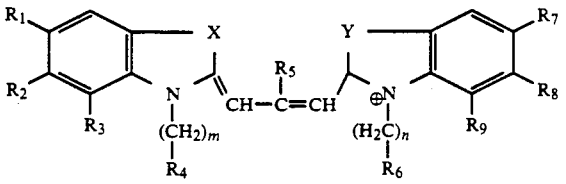

RS 1: $R_1, R_3, R_7, R_9 = H$; $R_2, R_8 = Cl$; $R_4 = SO_3^{\ominus}\oplus NH(C_2H_5)_3$; $R_5 = C_2H_5$; $R_6 = SO_3^{\ominus}$; $m, n = 3$; $X, Y = S$;

RS 2: $R_1, R_3, R_9 = H$; $R_2 = \text{Phenyl}$; $R_4 = -\underset{\underset{CH_3}{|}}{CH}-SO_3^{\ominus}K^{\oplus}$; $R_5 = C_2H_5$; $R_6 = SO_3^{\ominus}$; $R_7, R_8 = -OCH_3$; $m = 2$; $n = 3$; $X = O$; $Y = S$;

RS 3: $R_1, R_9 = H$; $R_2, R_3$ together $-CH=CH-CH=CH-$; $R_4 = SO_3^{\ominus}Na^{\oplus}$; $R_5 = C_2H_5$; $R_6 = SO_3^{\ominus}$; $R_7, R_8 = Cl$; $m, n = 3$; $X = S$; $Y = N-C_2H_5$;

RS 4: $R_1 = OCH_3$; $R_2, R_8 = CH_3$; $R_3, R_4, R_7, R_9 = H$; $R_5 = C_2H_5$; $R_6 = SO_3^{\ominus}$; $m = 2$; $n = 4$; $X = S$; $Y = Se$;

RS 5: $R_1, R_7 = H$; $R_2, R_3$ and $R_8, R_9$ together $-CH=CH-CH=CH-$; $R_4 = SO_3^{\ominus}\oplus NH(C_2H_5)_3$; $R_5 = C_2H_5$; $R_6 = SO_3^{\ominus}$; $m = 2$; $n = 3$; $X, Y = S$;

GS 1: $R_1, R_3, R_7, R_9 = H$; $R_2 = \text{Phenyl}$; $R_4 = \underset{\underset{CH_3}{|}}{CH}-SO_3^{\ominus}\overset{\oplus}{N}H(C_2H_5)_3$; $R_5 = C_2H_5$; $R_6 = SO_3^{\ominus}$; $R_8 = Cl$; $m = 2$; $n = 3$; $X, Y = O$;

GS 2: $R_1, R_2, R_7, R_8 = Cl$; $R_3, R_5, R_6, R_9 = H$; $R_4 = -\underset{\underset{CH_3}{|}}{CH}-SO_3^{\ominus}$; $m, n = 2$; $X, Y = N-C_2H_5$;

GS 3: $R_1, R_7 = H$; $R_2, R_3$ and $R_8, R_9$ together $-CH=CH-CH=CH-$; $R_4 = SO_3^{\ominus}Na^{\oplus}$; $R_5 = C_2H_5$; $R_6 = SO_3^{\ominus}$; $m, n = 3$; $X, Y = O$;

GS 4: $R_1, R_3, R_4, R_7, R_8, R_9 = H$; $R_2 = OCH_3$; $R_5 = C_2H_5$; $R_6 = SO_3^{\ominus}$; $m = 2$; $n = 4$; $X = O$; $Y = S$;

BS 1:

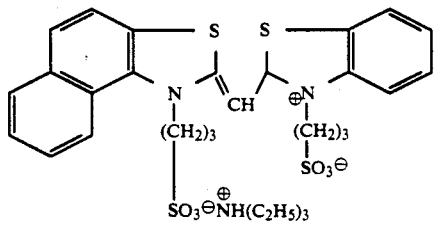

-continued

BS 2:

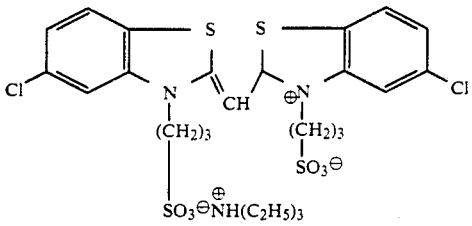

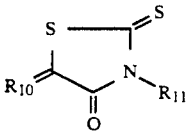

BS 3:

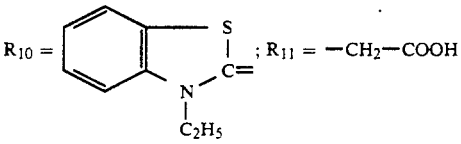

BS 4:

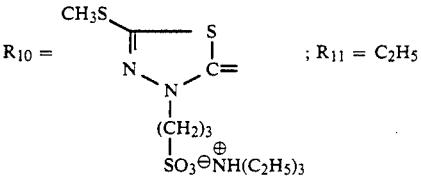

BS 5:

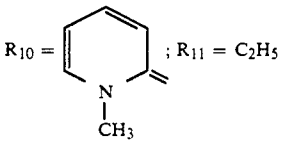

There is no need for sensitizers where the natural sensitivity of the silver halide is sufficient for a certain spectral region, for example the blue sensitivity of silver bromides.

Non-diffusing monomeric or polymeric color couplers are associated with the differently sensitized emulsion layers and may be arranged in the same layer or in an adjacent layer. Cyan couplers are normally associated with the red-sensitive layers, magenta couplers with the green-sensitive layers and yellow couplers with the blue-sensitive layers.

Color couplers for producing the cyan component dye image are generally couplers: of the phenol or α-naphthol type, of which the following are suitable examples:

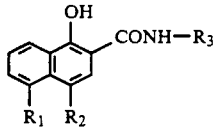

BG 1:

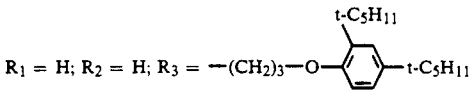

BG 2: $R_1$ = —NHCOOCH$_2$—CH(CH$_3$)$_2$; $R_2$ = H; $R_3$ = —(CH$_2$)$_3$—OC$_{12}$H$_{25}$

BG 3: $R_1$ = H; $R_2$ = —OCH$_2$—CH$_2$—SO$_2$CH$_3$; $R_3$ = C$_{16}$H$_{33}$

-continued

BG 4: $R_1$ = H; $R_2$ = —OCH$_2$—CONH—(CH$_2$)$_2$—OCH$_3$;

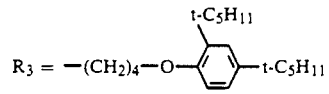

BG 5:

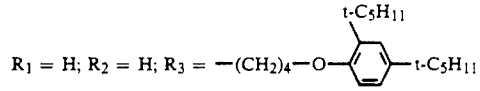

BG 6:

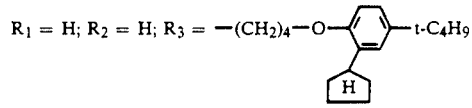

BG 7: $R_1$ = H; $R_2$ = Cl; $R_3$ = —C(C$_2$H$_5$)$_2$—(CH$_2$)$_{20}$—CH$_3$

BG 8: $R_1$ = H; $R_2$ = —O—CH$_2$—CH$_2$—S—CH(COOH)—C$_{12}$H$_{25}$; $R_3$ = Cyclohexyl

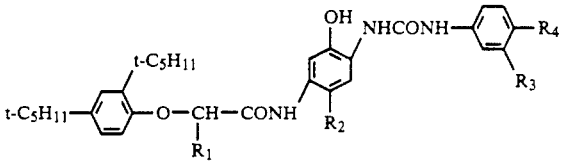

BG 9: $R_1$ = —C$_4$H$_9$; $R_2$ = H; $R_3$ = —CN; $R_4$ = Cl

BG 10: $R_1$ = —C$_4$H$_9$; $R_2$ = H; $R_3$ = H; $R_4$ = —SO$_2$CHF$_2$

BG 11: $R_1$ = —C$_4$H$_9$;

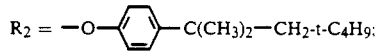

$R_3$ = H; $R_4$ = —CN

BG 12: $R_1$ = C$_2$H$_5$; $R_2$ = H; $R_3$ = H; $R_4$ = —SO$_2$CH$_3$

BG 13: $R_1$ = —C$_4$H$_9$; $R_2$ = H; $R_3$ = H; $R_4$ = —SO$_2$—C$_4$H$_9$

BG 14: $R_1$ = —C$_4$H$_9$; $R_2$ = H; $R_3$ = —CN; $R_4$ = —CN

BG 15: $R_1$ = —C$_4$H$_9$; $R_2$ = H; $R_3$ = H; $R_4$ = —SO$_2$—CH$_2$—CHF$_2$

BG 16: $R_1$ = —C$_2$H$_5$; $R_2$ = H; $R_3$ = H; $R_4$ = —SO$_2$CH$_2$—CHF—C$_3$H$_7$

BG 17: $R_1$ = —C$_4$H$_9$; $R_2$ = H; $R_3$ = H; $R_4$ = F

BG 18: $R_1$ = —C$_4$H$_9$; $R_2$ = H; $R_3$ = H; $R_4$ = —SO$_2$CH$_3$

BG 19: $R_1$ = —C$_4$H$_9$; $R_2$ = H; $R_3$ = H; $R_4$ = —CN

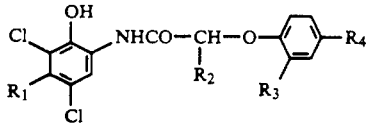

BG 20: $R_1$ = —CH$_3$; $R_2$ = —C$_2$H$_5$; $R_3$; $R_4$ = -t-C$_5$H$_{11}$

BG 21: $R_1$ = —CH$_3$; $R_2$ = H; $R_3$, $R_4$ = -t-C$_5$H$_{11}$

BG 22: $R_1$ = —C$_2$H$_5$; $R_2$ = —C$_2$H$_5$; $R_3$, $R_4$ = -t-C$_5$H$_{11}$

BG 23: $R_1$ = —C$_2$H$_5$; $R_2$ = —C$_4$H$_9$; $R_3$, $R_4$ = -t-C$_5$H$_{11}$

BG 24: $R_1$ = —C$_2$H$_5$; $R_2$ = —C$_4$H$_9$; $R_3$, $R_4$ = -t-C$_4$H$_9$

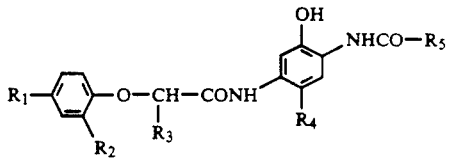

BG 25: $R_1$, $R_2$ = -t-C$_5$H$_{11}$; $R_3$ = —C$_4$H$_9$; $R_4$ = H; $R_5$ = —C$_3$F$_7$

BG 26: $R_1$ = —NHSO$_2$—C$_4$H$_9$; $R_2$ = H; $R_3$ = —C$_{12}$H$_{25}$; $R_4$ = Cl; $R_5$ = Phenyl BG 27: $R_1$, $R_2$ = -t-C$_5$H$_{11}$; $R_2$ = Cl, $R_3$ = —CH(CH$_3$)$_2$; $R_4$ = Cl; $R_5$ = Pentafluorophenyl -continued
| | |
|---|---|
| BG 28: | $R_1$ = -t-$C_5H_{11}$; $R_2$ = Cl; $R_3$ = $-C_6H_{13}$; $R_4$ = Cl; $R_5$ = -2-Chlorophenyl |
Color couplers for producing the magenta component dye image are generally couplers of the 5-pyrazolone type, the indazolone type or the pyrazoloazole type, of which suitable examples are:
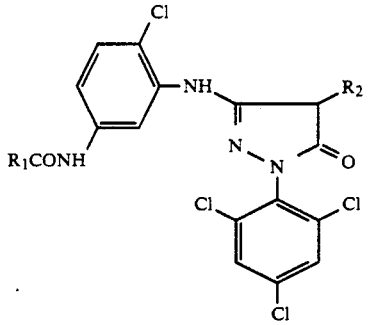
PP 1:
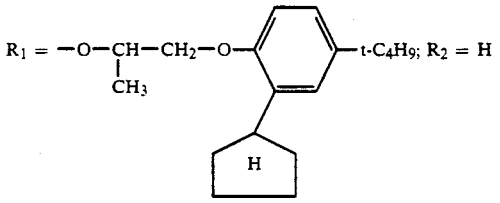
PP 2:
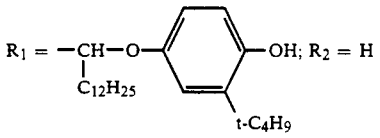
PP 3: $R_1$ = $-C_{13}H_{27}$; $R_2$ = H
PP 4: $R_1$ = $-C_{16}H_{33}$; $R_2$ = H
PP 5:
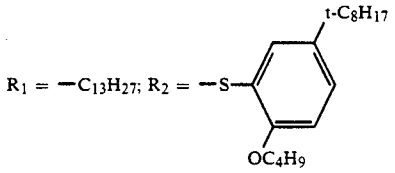
PP 6:
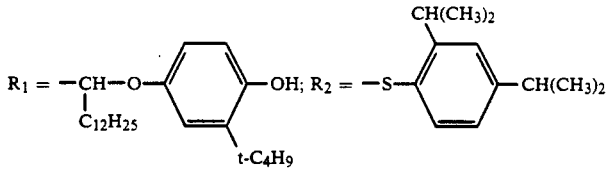
PP 7:
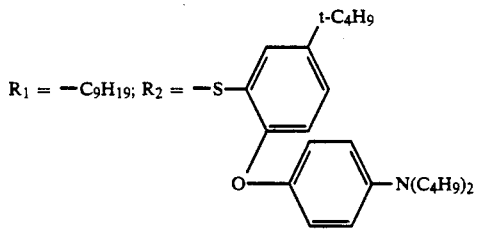
PP 8:
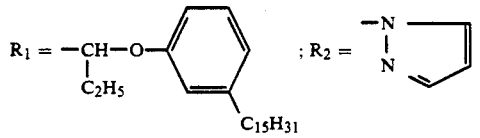

-continued
PP 9:
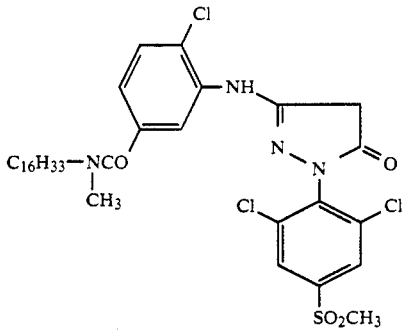
PP 10:
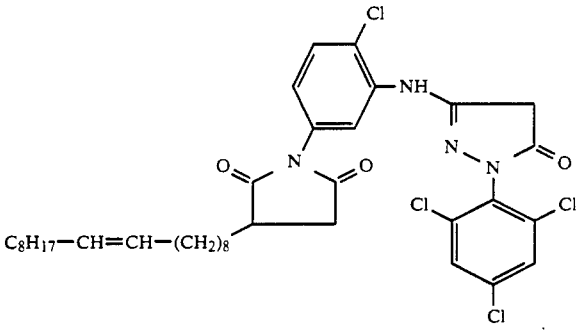
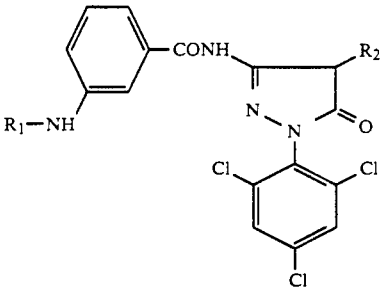
PP 11:
$R_1 = -SO_2-C_6H_4-OC_{12}H_{25}$; $R_2 = H$
PP 12:
$R_1 = -CO-CH_2-O-C_6H_3(t\text{-}C_5H_{11})-t\text{-}C_5H_{11}$; $R_2 = H$
PP 13:
$R_1 = -CO-CH(C_2H_5)-O-C_6H_3(t\text{-}C_5H_{11})-t\text{-}C_5H_{11}$; $R_2 = H$
PP 14:
$R_1 = -CO-CH(C_2H_5)-O-C_6H_3(t\text{-}C_5H_{11})-t\text{-}C_5H_{11}$;

-continued
$R_2 =$ 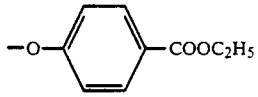
PP 15: 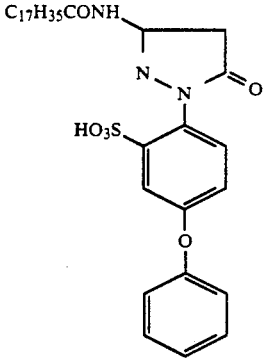
PP 16: 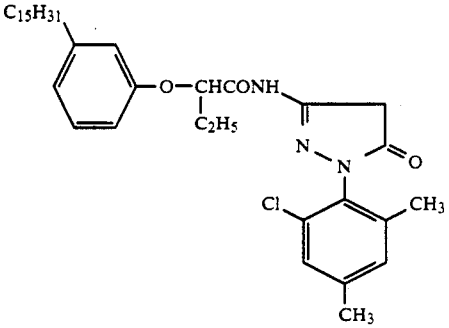
PP 17: 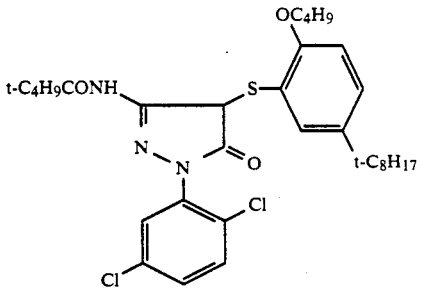
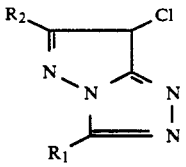
PP 18:
$R_1 =$ 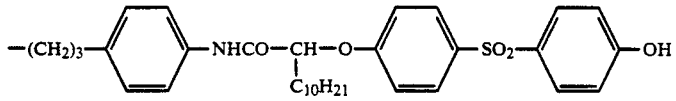
$R_2 = -CH_3$
PP 19:
$R_1 =$ 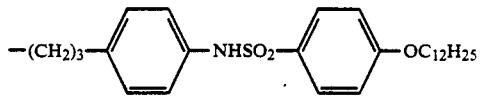
$R_2 = -CH_3$ -continued

PP 20:

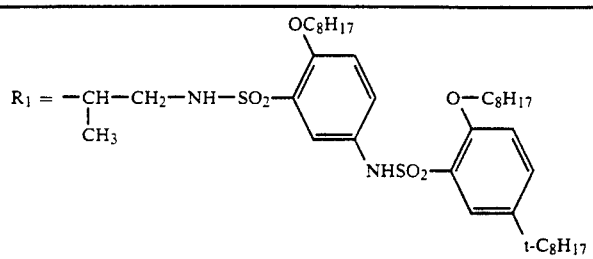

$R_2$ = -t-$C_4H_9$

PP 21:

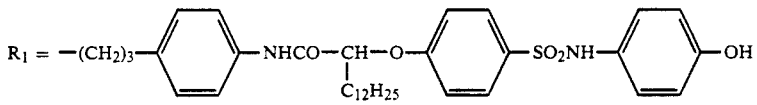

$R_2$ = $-CH_3$

PP 22:

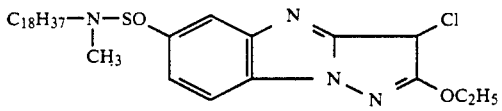

Color couplers for producing the yellow component dye image are generally couplers containing an open-chain ketomethylene group, more especially couplers of the α-acyl acetamide type, of which suitable examples are α-benzoyl acetanilide couplers and α-pivaloyl acetanilide couplers corresponding to the following formulae:

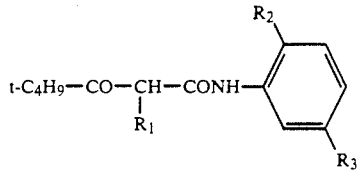

GB 1:

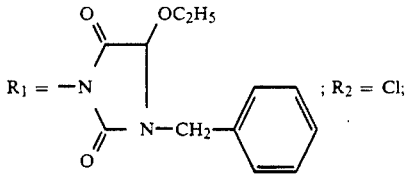

; $R_2$ = Cl;

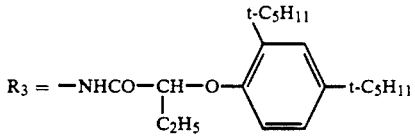

GB 2:

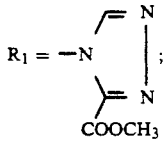

; $R_2$ = $-OC_{16}H_{33}$; $R_3$ = $-SO_2NHCH_3$

GB 3:

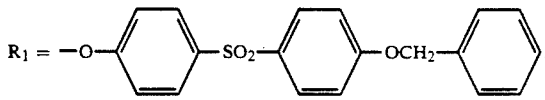

; $R_2$ = Cl $R_3$ = $-NHSO_2-C_{16}H_{33}$

-continued
GB 4:
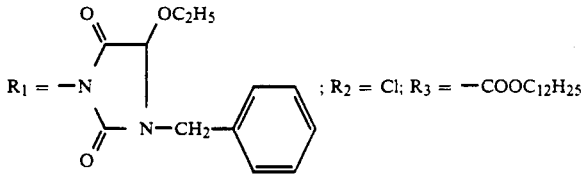
$R_1$ = ; $R_2$ = Cl; $R_3$ = $-COOC_{12}H_{25}$
GB 5:
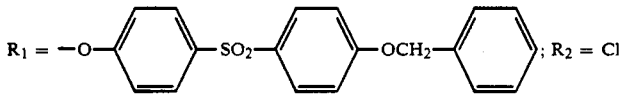
$R_1$ = ; $R_2$ = Cl
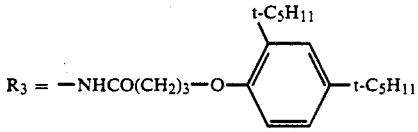
$R_3$ = $-NHCO(CH_2)_3-O-$ t-$C_5H_{11}$
GB 6:
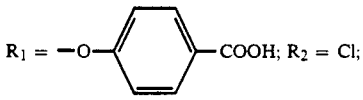
$R_1$ = COOH; $R_2$ = Cl;
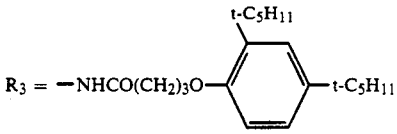
$R_3$ = $-NHCO(CH_2)_3O-$ t-$C_5H_{11}$
GB 7:
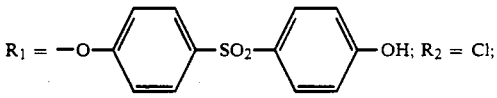
$R_1$ = OH; $R_2$ = Cl;
$R_3$ = $-NHSO_2C_{16}H_{33}$
GB 8:
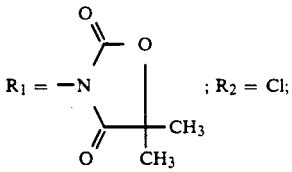
$R_1$ = ; $R_2$ = Cl;
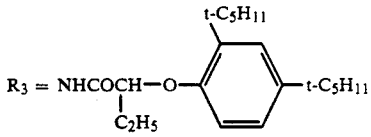
$R_3$ = NHCOCH(C$_2$H$_5$)-O- t-$C_5H_{11}$
GB 9:
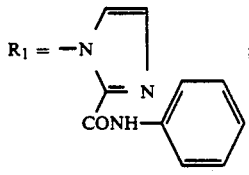
$R_1$ = ; $R_2$ = $OC_{16}H_{33}$;
$R_3$ = $-SO_2NHCOC_2H_5$
GB 10:
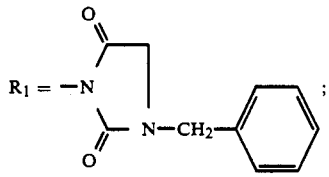
$R_1$ = ; $R_2$ = Cl;

-continued
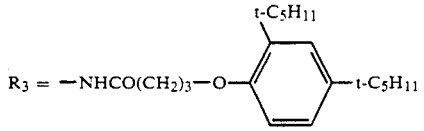
GB 11:
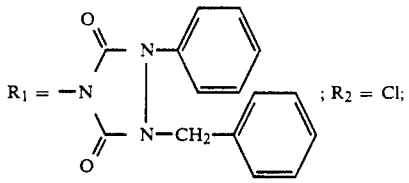
; $R_2$ = Cl;
$R_3$ = —COOCH(C$_4$H$_9$)—COOC$_{12}$H$_{25}$
GB 12:
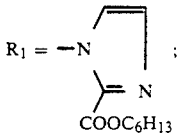
; $R_2$ = Cl;
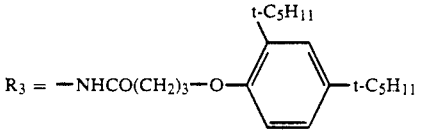
GB 13:
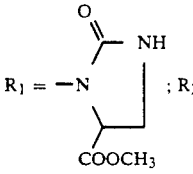
; $R_2$ = —OC$_{16}$H$_{33}$; $R_3$ = —SO$_2$NHCH$_3$
GB 14:
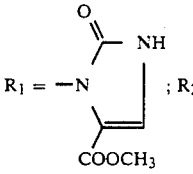
; $R_2$ = Cl
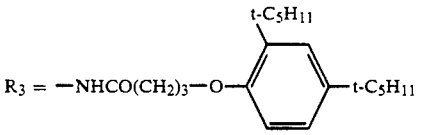
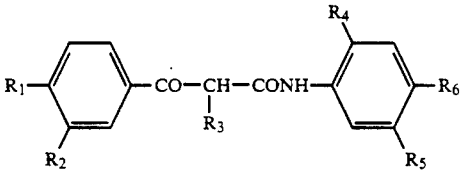
GB 15: $R_1$, $R_3$, $R_5$, $R_6$ = H; $R_4$ = —OCH$_3$;
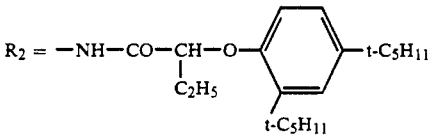
GB 16: $R_2$, $R_6$ = H; $R_1$ = —OC$_{16}$H$_{33}$; $R_4$, $R_5$ = —OCH$_3$;

-continued
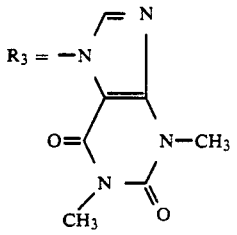
GB 17: $R_2$, $R_6$ = H; $R_1$ = $-OCH_3$, $R_4$ = Cl; $R_5$ = $-COOC_{12}H_{25}$;
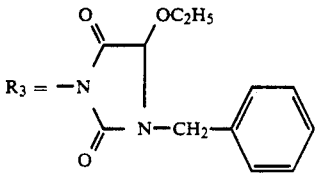
GB 18: $R_2$ = H; $R_1$ = $-OC_{16}H_{33}$; $R_4$ = Cl; $R_5$, $R_6$ = $-OCH_3$;
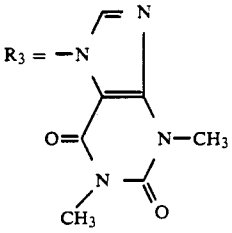
GB 19: $R_2$, $R_5$ = H; $R_1$ = $-OC_{16}H_{33}$; $R_4$ = $-OCH_3$;
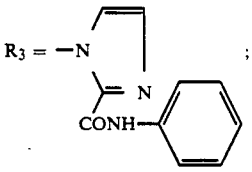
; $R_6$ = $-SO_2N(CH_3)_2$
GB 20: $R_2R_6$ = H; $R_1$, $R_4$ = $-OCH_3$;
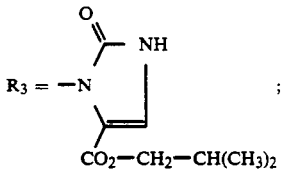
;
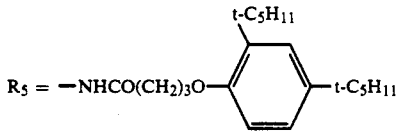

-continued

GB 21:

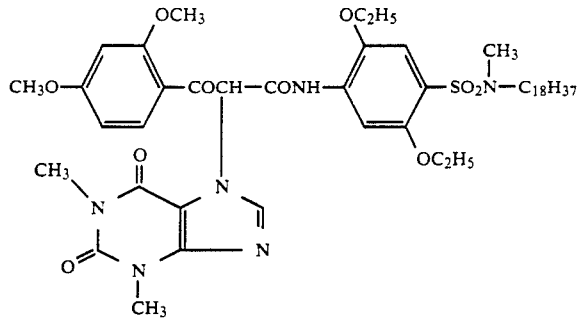

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such as these are known DIR couplers and also DAR and FAR couplers.

Examples of white couplers are:

W1

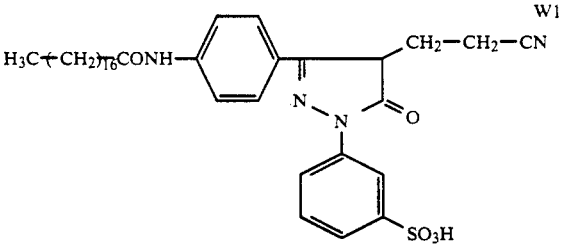

W2

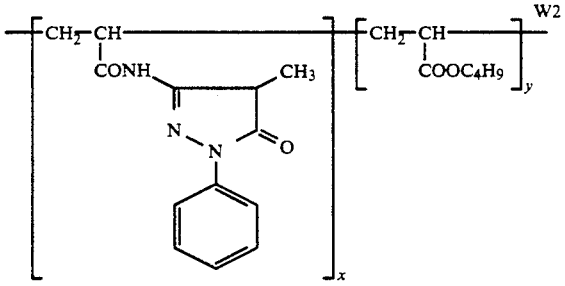

-continued

W3

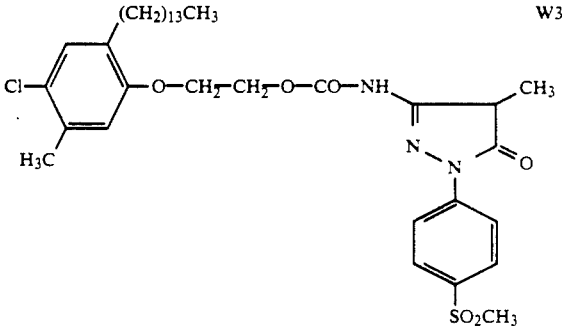

W4

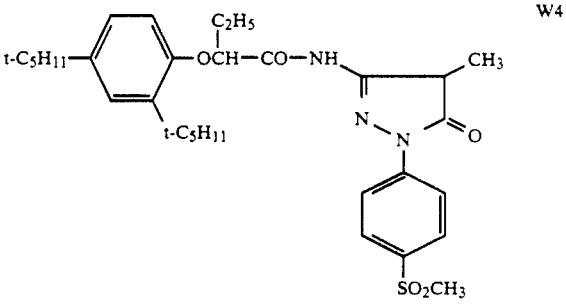

W5

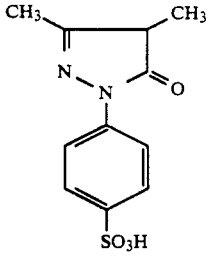

Examples of mask couplers are:

M1
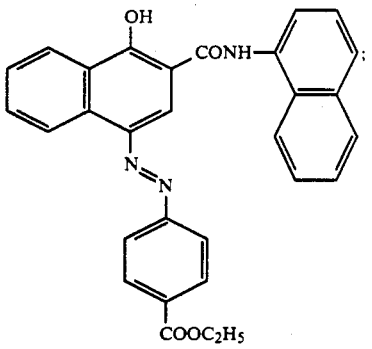
M2
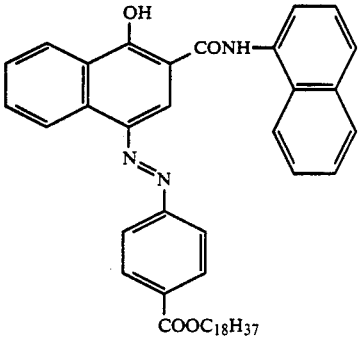
M3
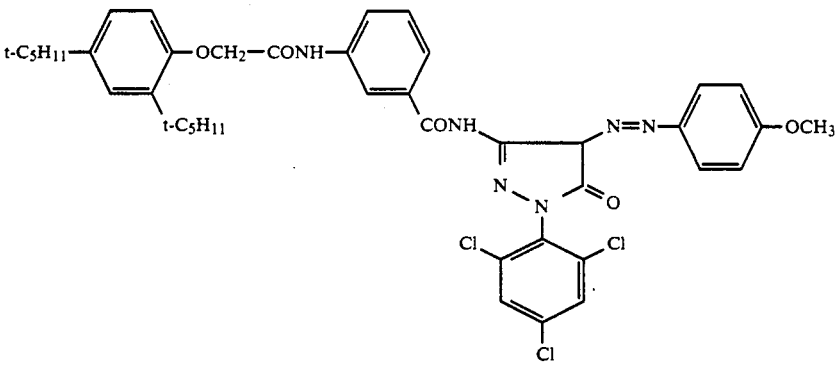
M4
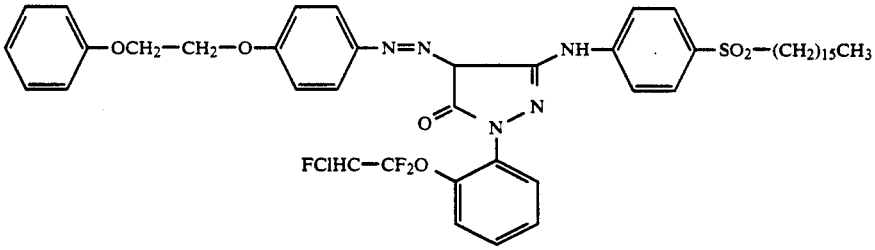
M5
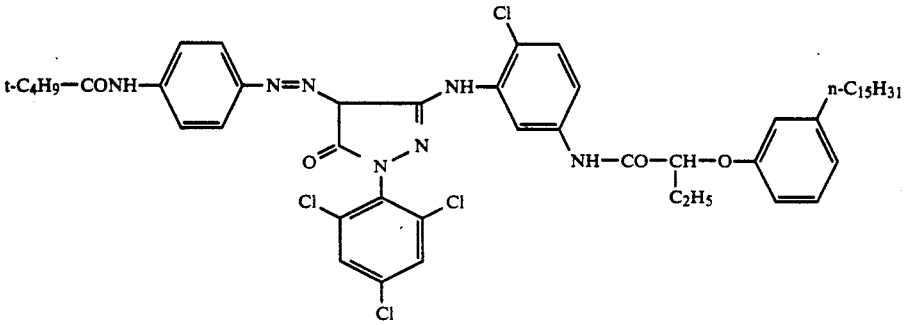

-continued
M6
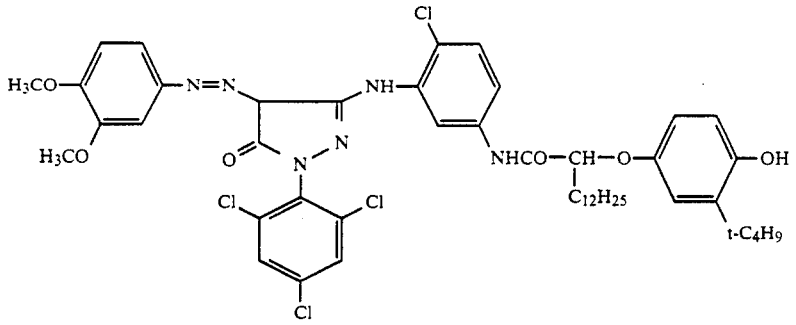
M7
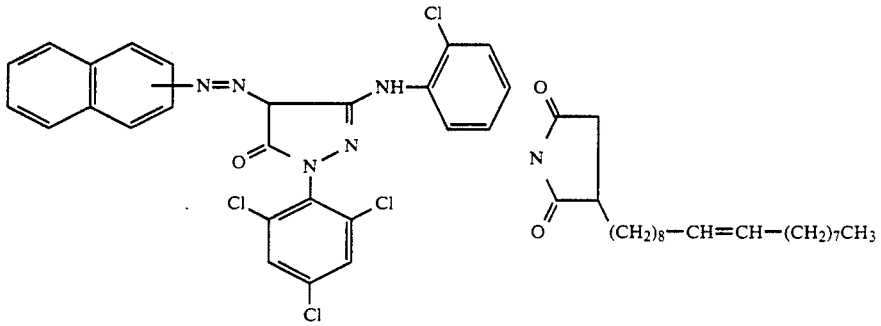
M8
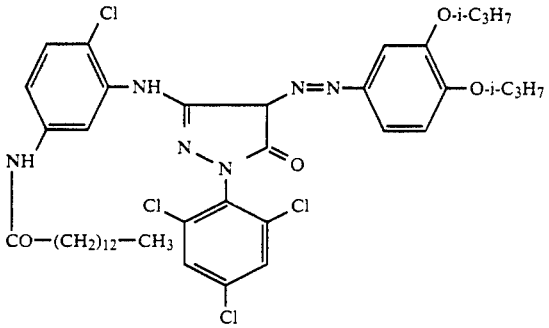
M9
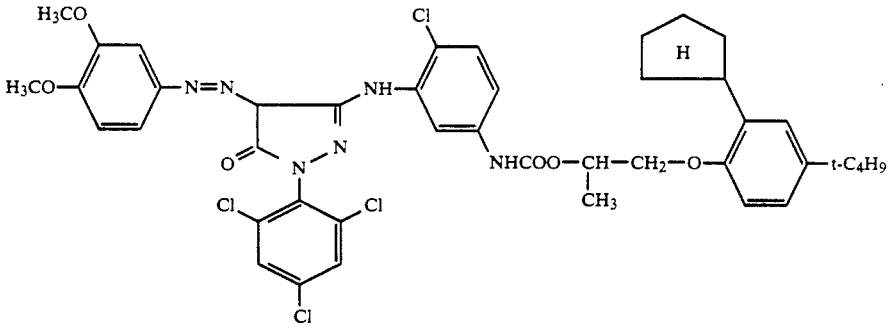
M10
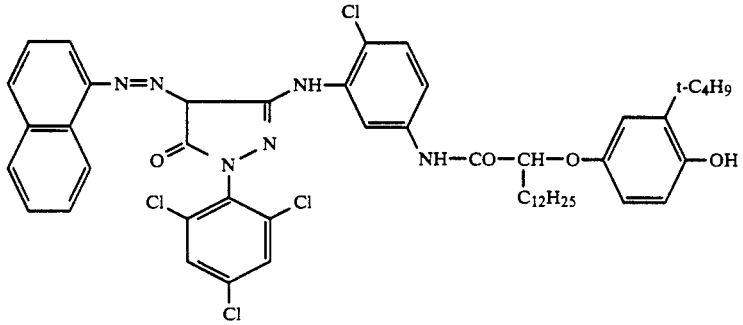

-continued
M11
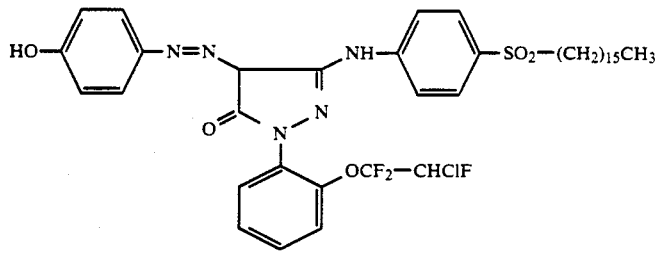
M12
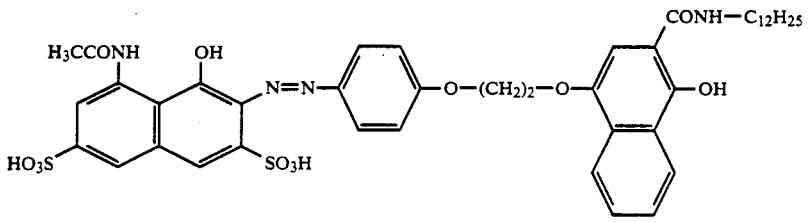
M13
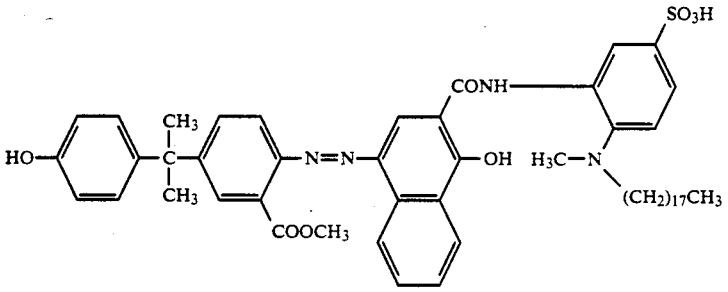
M14
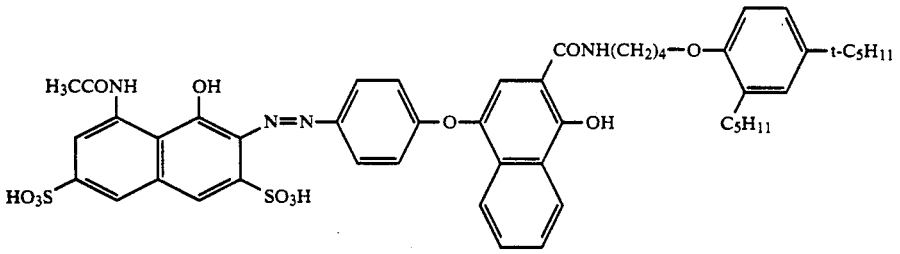
M15
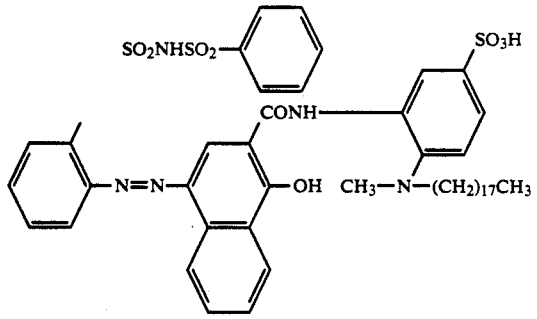

-continued

M16

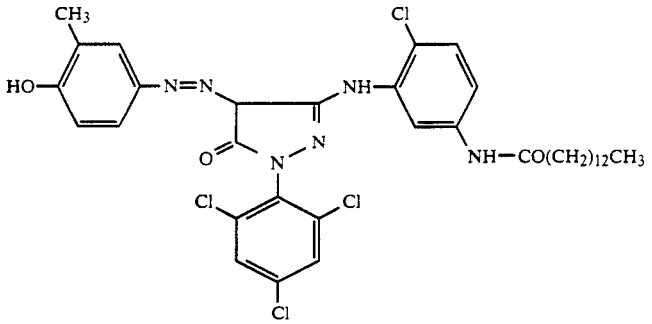

M17

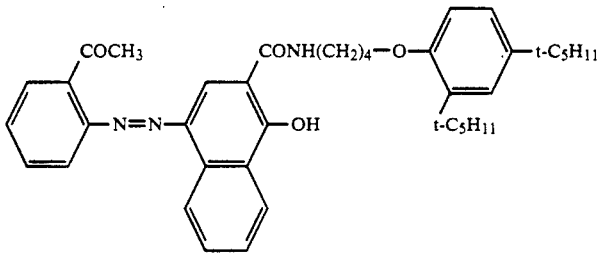

DIR couplers containing development inhibitors of the azole type, for example triazoles and benzotriazoles, are described in DE-A-24 14 006, 26 10 546, 26 59 417, 27 54 281, 27 26 180, 36 26 219, 36 30 564, 36 36 824, 36 44 416 and 28 42 063. Further advantages in regard to color reproduction, i.e. color separation and color purity, and in regard to detail reproduction, i.e. sharpness and graininess, can be obtained with DIR couplers which, for example, do not release the development inhibitor as the direct result of coupling with an oxidized color developer, but only after a further reaction, for example with a timing group. Examples of DIR couplers such as these can be found in DE-A-28 55 697, 32 99 671 38 18 231, 35 18 797, in EP-A-157 146 and 204 175, in U.S. application Ser. Nos. 4,146,396 and 4,438,393 and in GB-A-2,072,363.

DIR couplers releasing a development inhibitor which is decomposed in the developer bath to photographically substantially inactive products are described, for example, in DE-A-3 209 486 and in EP-A-167 168 and 219 713. Problem-free development and stable processing are achieved by this measure.

Where DIR couplers, particularly those releasing a readily diffusible development inhibitor, are used, improvements in color reproduction, for example a more differentiated color reproduction, can be obtained by suitable measures during optical sensitization, as described for example in EP-A-115 304, 167 173, GB-A-2,165,058, DE-A-37 00 419 and U.S. application Ser. No. 4,707,436.

In a multilayer photographic material, the DIR couplers may be added to various layers, including for example even non-photosensitive layers or intermediate layers. However, they are preferably added to the photosensitive silver halide emulsion layers, the characteristic properties of the silver halide emulsion, for example its iodide content, the structure of the silver halide grains or their grain size distribution, influencing the photographic properties obtained. The effect of the inhibitors released may be limited, for example by the incorporation of an inhibitor-trapping layer according to DE-A-24 31 223. For reasons of reactivity or stability, it may be of advantage to use a DIR coupler which, in the particular layer into which it is introduced, forms a color differing from the color to be produced in that layer during the coupling reaction.

To increase sensitivity, contrast and maximum density, it is possible to use above all DAR or FAR couplers which release a development accelerator or a fogging agent. Compounds of this type are described, for example, in DE-A-25 34 466, 32 09 110, 33 33 355, 34 10 616, 34 29 545, 34 41 823, in EP-A-89 834, 110 511, 118 087, 147 765 and in U.S. application Ser. Nos. 4,618,572 and 4,656,123.

An example of the use of BAR (bleach accelerator releasing) couplers can be found in EP-A-193 389.

It can be of advantage to modify the effect of a photographically active group released from the coupler by an intermolecular reaction between this group after its release and another group in accordance with DE-A-35 06 805.

The following are examples of DIR couplers:

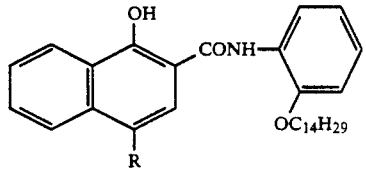

-continued
Dir 1
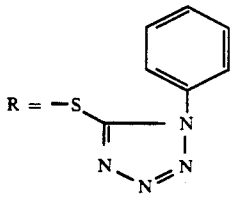
Dir 2
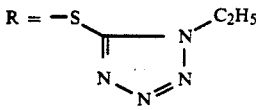
DIR 3
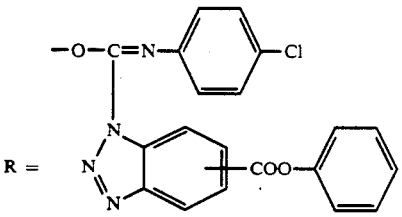
DIR 4
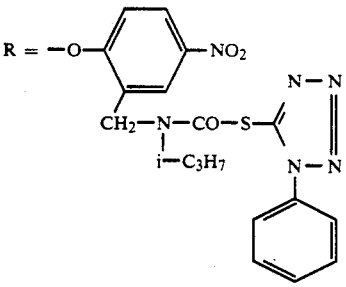
DIR 5
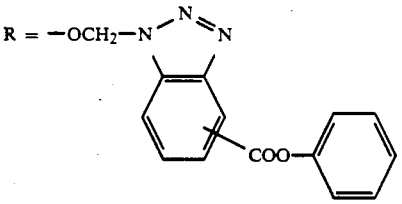
DIR 6
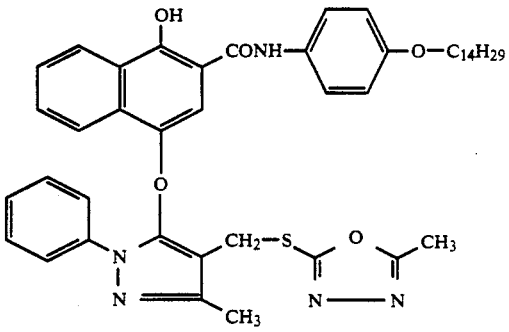

-continued
DIR 7
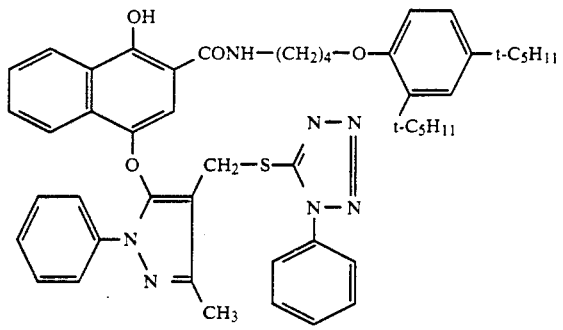
DIR 8
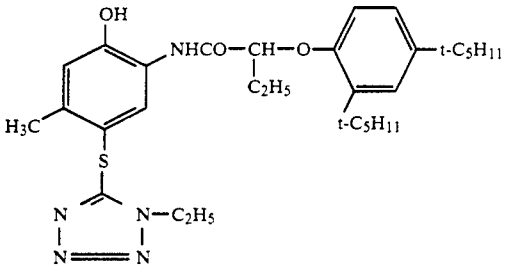
DIR 9
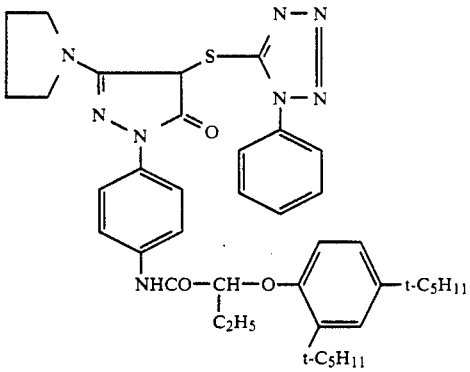
DIR 10
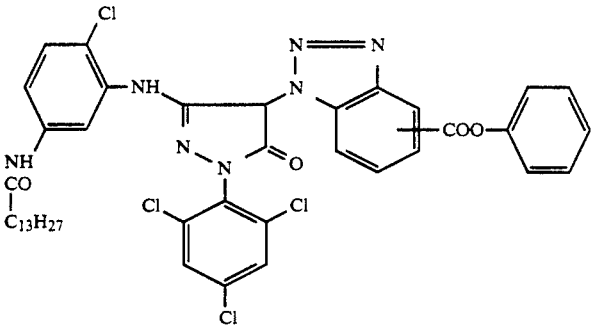

-continued
DIR 11
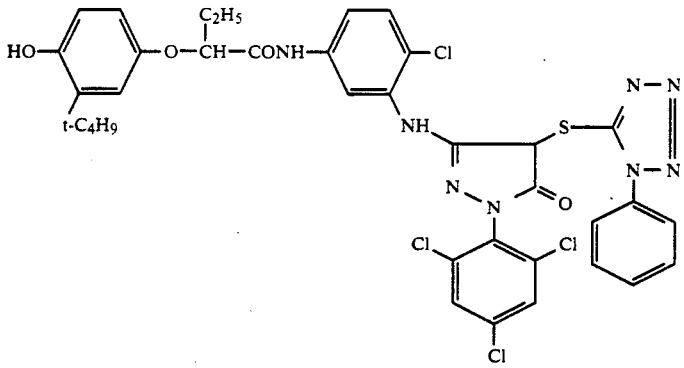
DIR 12
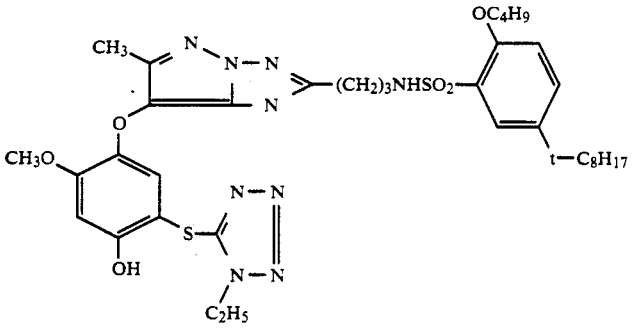
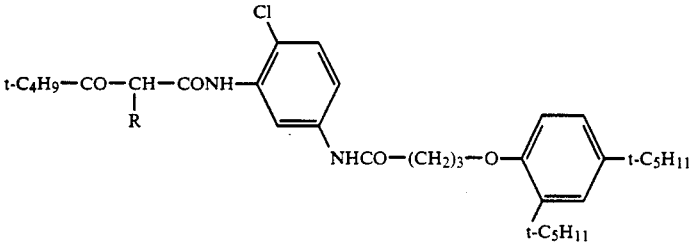
DIR 13
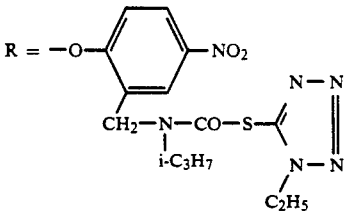
DIR 14
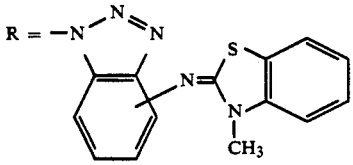
DIR 15
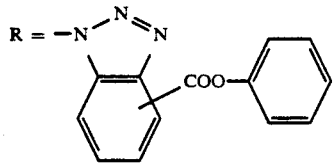

-continued
DIR 16
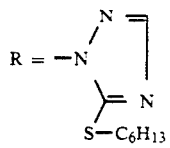
DIR 17
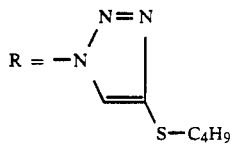
DIR 18
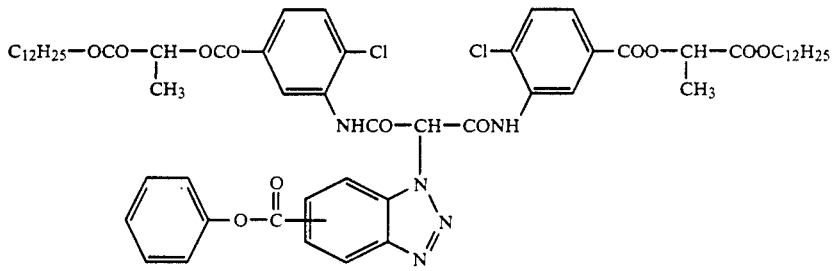
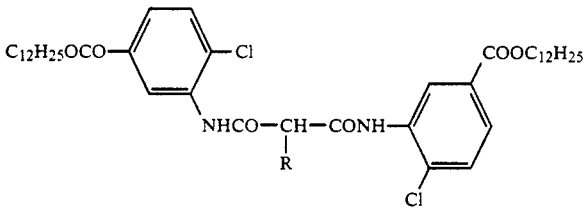
DIR 19
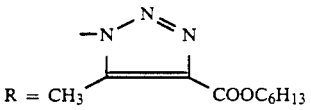
DIR 20
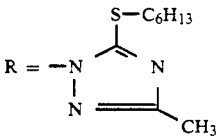
DIR 21
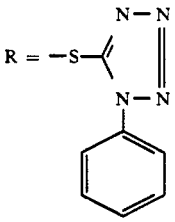
DIR 22
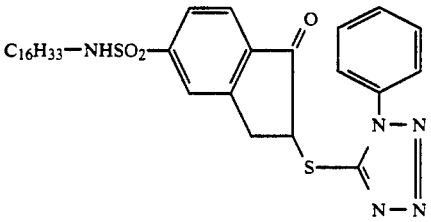

-continued

DIR 23

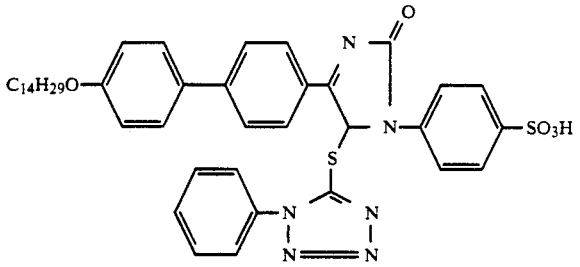

DIR 24

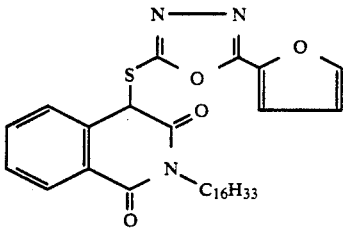

The following are examples of DAR couplers:

DAR 1

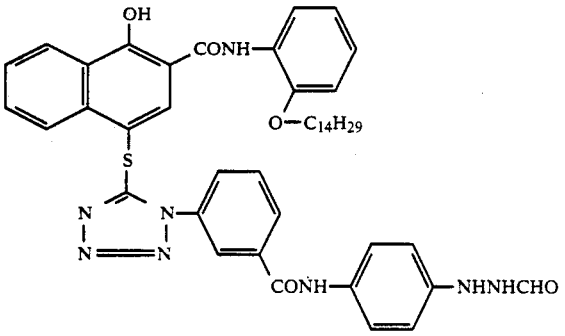

DAR 2

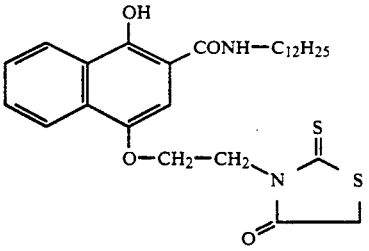

DAR 3

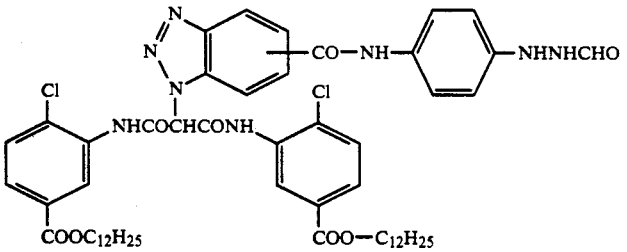

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A-15 47 640).

The releasable group may also be a ballast group, so that coupling products which are diffusible or which at least show slight or limited mobility are obtained in the reaction with color developer oxidation products (U.S. application Ser. No. 4,420,556).

The material may also contain compounds different from couplers which may release, for example, a development inhibitor, a development accelerator, a bleach accelerator, a developer, a silver halide solvent, a fogging agent or an anti-fogging agent, for example so-called DIR hydroquinones and other compounds of the type described, for example, in U.S. application Ser. Nos. 4,636,546, 4,345,024, 4,684,604 and in DE-A-31 45 640, 25 15 213, 24 47 079 and in EP-A-198 438. These compounds perform the same function as the DIR, DAR or FAR couplers except that they do not form coupling products.

High molecular weight couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-O-27 284, U.S. application Ser. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. application Ser. Nos. 2,322,027, 2,801,170, 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-O 130 115, U.S. application Ser. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octyl aniline, paraffin, dodecylbenzene and diisopropyl naphthalene.

Each of the differently sensitized photosensitive layers may consist of a single layer or may even comprise two or more partial silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Providing the natural sensitivity of the green-sensitive or red-sensitive layers is suitably low, it is possible to select other layer arrangements without the yellow filter layer, in which for example the blue-sensitive layers, then the red-sensitive layers and finally the green-sensitive layers follow one another on the support.

The non-photosensitive intermediate layers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (December 1978), Chapter VII, 17 842/1979, pages 94–97 and 18 716/1979, page 650 and in EP-A-69 070, 98 072, 124 877, 125 522 and in U.S. application Ser. No. 463,226.

The following are examples of particularly suitable compounds:

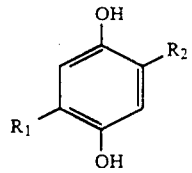

$R_1, R_2$ = -t-$C_8H_{17}$
-s-$C_{12}H_{25}$
-t-$C_6H_{13}$
$-C(CH_3)_2-(CH_2)_3-COO-n-C_6H_{13}$
-s-$C_8H_{17}$
-$C_{15}H_{31}$

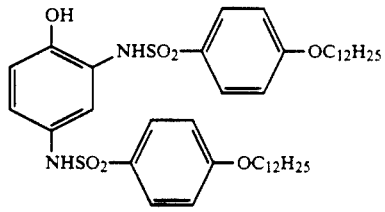

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. application Ser. No. 3,533,794), 4-thiazolidone compounds (U.S. application Ser. Nos. 3,314,794 and 3,352,681), benzophenone compounds (JP-A-2784/71), cinnamic acid ester compounds (U.S. application Ser. Nos. 3,705,805 and 3,707,375), butadiene compounds (U.S. application Ser. No. 4,045,229) or benzoxazole compounds (U.S. application Ser. No. 3,700,455).

The following are examples of particularly suitable compounds:

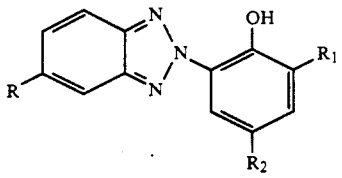

R, $R_1$ = H; $R_2$ = t-$C_4H_9$
R = H; $R_1$, $R_2$ = t-$C_4H_9$
R = H; $R_1$, $R_2$ = t-$C_5H_{11}$
R = H; $R_1$ = s-$C_4H_9$; $R_2$ = t-$C_4H_9$
R = Cl; $R_1$ = t-$C_4H_9$; $R_2$ = s-$C_4H_9$
R = Cl; $R_1$, $R_2$ = t-$C_4H_9$
R = Cl; $R_1$ = t-$C_4H_9$; $R_2$ = $-CH_2-CH_2-COOC_8H_{17}$
R = H; R = i-$C_{12}H_{25}$; $R_2$ = $CH_3$
R, $R_1$, $R_2$ = t-$C_4H_9$

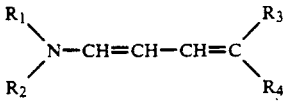

$R_1$, $R_2$ = n-$C_6H_{13}$; $R_3$, $R_4$ = CN $R_1$, $R_2$ = $C_2H_5$; $R_3$ = $-SO_2-$ 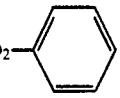 ; $R_4$ = $COOC_8H_{17}$ $R_1$, R = $C_2H_5$; $R_3$ = $-SO_2-$ 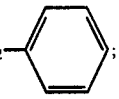 ; $R_4$ = $COOC_{12}H_{25}$ $R_1$, $R_2$ = $CH_2=CH-CH_2$; $R_3$, $R_4$ = CN

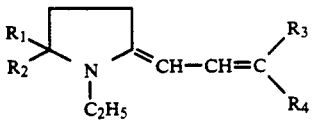

$R_1$, $R_2$ = H; $R_3$ = CN; $R_4$ = $CO-NHC_{12}H_{25}$
$R_1$, $R_2$ = $CH_3$; $R_3$ = CN; $R_4$ = $CO-NHC_{12}H_{25}$

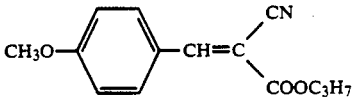

It is also possible to use UV-absorbing couplers (such as cyan couplers of the α-naphthol type) and UV-absorbing polynmers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, in U.S. application Ser. Nos. 2,632,701 and 3,269,840 and in GB-A-852,075 and 1,319,763.

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure I7 643, December 1978, Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

The following are examples of suitable formalin scavengers:

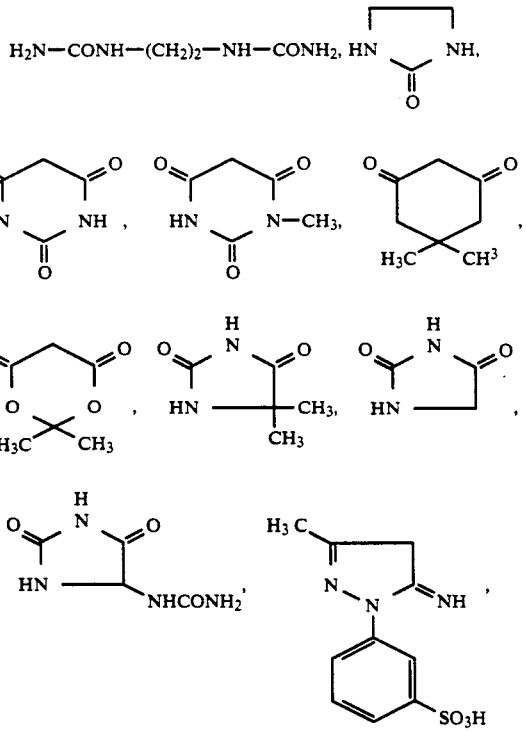

-continued

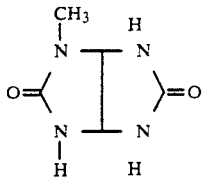

Additives for improving dye, coupler and white stability and for reducing color fogging (Research Disclosure 17 643/1978, Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. application Ser. No. 4,268,593) are particularly effective for preventing the impairment (deterioration or degradation) of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment (deterioration or degradation) of magenta-red dye images, particularly their impariment (deterioration or degradation) as a result of the effect of light.

The following are examples of particularly suitable compounds:

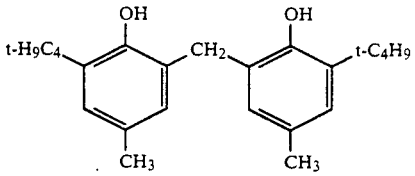

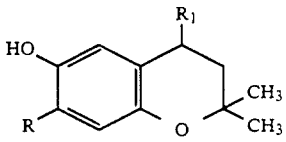

R = t-$C_8H_{17}$; $R_1$ = $CH_3$
R = n-$C_8H_{17}$; $R_1$ = i-$C_3H_7$

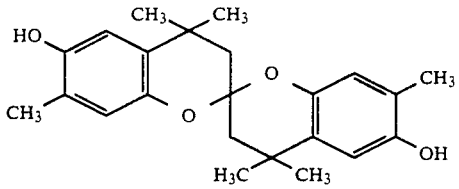

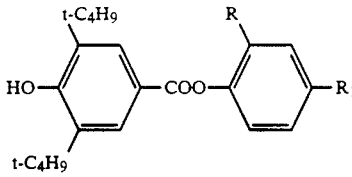

R, $R_1$ = t-$C_4H_9$
R, $R_1$ = t-$C_5H_{11}$

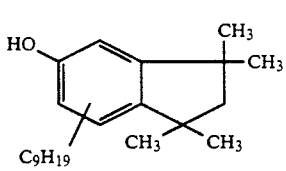

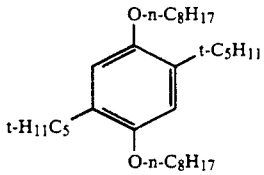

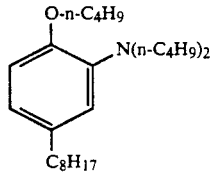

-continued

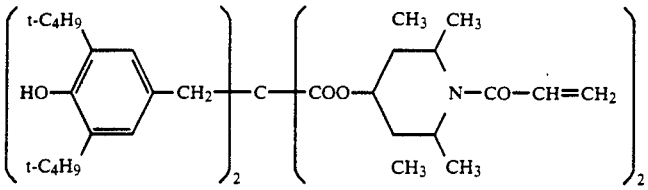

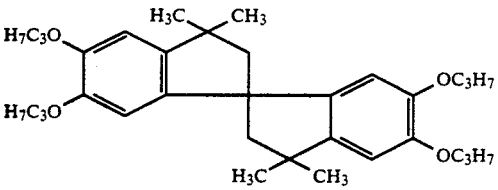

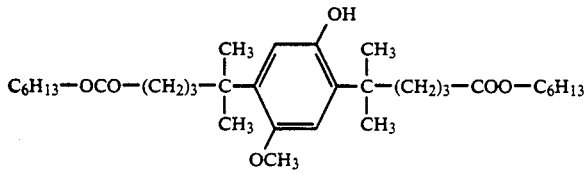

and the compounds mentioned as DOP trappers.

The layers of the photographic material may be hardened with the usual hardness. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. application Ser. Nos. 3,288,775, 2,732,303, GB-A-974,723 and GB-A-1,167,207), divinylsulfone compounds, 5-acetyl-1,3-diacryloyl hexahydro-1,3,5-triazine and other compounds containing a reactive olefin bond (U.S. application Ser. Nos. 3,635,718, 3,232,763 and GB-A-994,869); N-hydroxymethyl phthalimide and other N-methylol compounds (U.S. application Ser. Nos. 2,732,316 and 2,586,168); isocyanates (U.S. application Ser. No. 3,103,437); aziridine compounds (U.S. application Ser. Nos. 3,017,280 and 2,983,611); acid derivatives (U.S. application Ser. Nos. 2,725,294 and 2,725,295); compounds of the carbodiimide type (U.S. application Ser. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. application Ser. No. 4,111,926), dihydroquinoline compounds (U.S. application Ser. No. 4,013,468), 2-sulfonyloxy pyridinium salts (JP-A-110 762/81), formamidinium salts (EP-A-0 162 308), Compounds containing two or more N-acyloximino groups (U.S. application Ser. No. 4,052,373), epoxy compounds (U.S. application Ser. No. 3,091,537), compounds of the isoxazole type (U.S. application Ser. Nos. 3,321,313 and 3,543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and cross-linking of the gelatine.

Suitable examples of instant hardeners are compounds corresponding to the following general formulae:

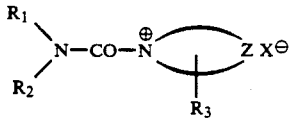

(a)

in which $R_1$ is alkyl, aryl or aralkyl, $R_2$ has the same meaning as R or represents alkylene, arylene, aralkylene or alkaralkylene, the second bond being attached to a group corresponding to formula

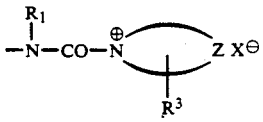

or $R_1$ and $R_2$ together represent the atoms required to complete an optionally substituted heterocyclic ring, for example a piperidine, piperazine or morpholine ring, the ring optionally being substituted, for example, by $C_{1-3}$ alkyl or halogen, $R_3$ is hydrogen, alkyl, aryl, alkoxy, $—NR_4—COR_5$, $—(CH_2)_m—NR_8R_9$, $—(CH_2)_n—CONR_{13}R_{14}$ or $$—(CH_2)_p—\underset{\underset{R_{15}}{|}}{CH}—Y—R_{16}$$

or is a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$–$C_4$ alkyl, $R_5$ being hydrogen, $C_{1-4}$ alkyl or $NR_6R_7$, $R_8$ being $—COR_{10}$, $R_{10}$ being $NR_{11}R_{12}$, $R_{11}$ being $C_{1-4}$ alkyl or aryl, particularly phenyl, $R_{12}$ being hydrogen, $C_{1-4}$ alkyl or aryl, particularly phenyl, $R_{13}$ being hydrogen, $C_{1-4}$ alkyl or aryl, particularly phenyl, $R_{16}$ being hydrogen, $C_{1-4}$ alkyl, $COR_{18}$ or $CONHR_{19}$, m being a number of 1 to 3, n being a number of 0 to 3, p being a number of 2 to 3 and Y being O or $NR_{17}$ or $R_{13}$ and $R_{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^{\ominus}$ is an anion which is unnecessary where an anionic group is already attached to the rest of the molecule;

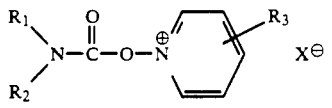

(b)

in which $R_1$, $R_2$, $R_3$ and $X^{\ominus}$ are as defined for formula (a).

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

Color photographic negative materials are normally processed by development, bleaching, fixing and washing or by development, bleaching, fixing and stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methanesulfonamidoethyl)-3-methyl-p-phenylenediamine, 1-(N-ethyl-N-hydroxyethyl)-3-methyl TM p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

Color development may be followed by an acidic group bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraactic acid, diethylenetriamine pentaacetic acid, nitrilotriacetic acid, iminodiazetic acid, N-hydroxyethyl ethylene diamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

Color reversal materials are first subjected to development with a black-and-white developer of which the oxidation product is not capable of reacting with the color couplers. Development is followed by a diffuse second exposure and then by development with a color developer, bleaching and fixing.

EXAMPLE 1

A cubic silver chloride bromide iodide emulsion containing 3 mol-% chloride and 4.5 mol-% iodide, in which 90% of the diameters of the spheres equal in diameter to the emulsion grains were >0.40 μm and 90%<0.87 μm and the most common diameter was 0.58 μm, was ripened with 8.4 μmol sodium thiosulfate/mol Ag, 6.3 μmol sodium dithiosulfatoaurate (I)/mol Ag and 441 μmol ammonium thiocyanate/mol Ag for 2 hours at 58° C. and spectrally sensitized with 0.188 μmol/mol Ag of dye I and 0.325 μmol/mol Ag of dye II:

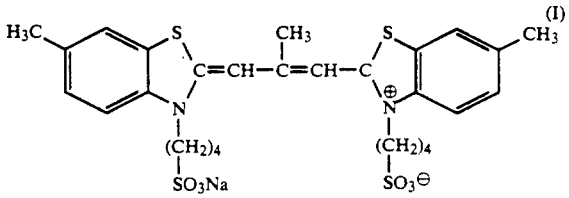

(I)

-continued

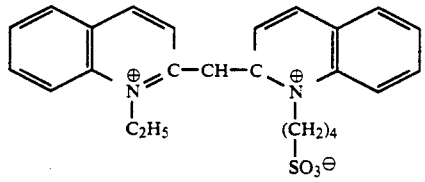

(II)

2.0 Mmol 6-methyl-4-hydroxy-1,3,3a,7-tetraazaindene/mol Ag were then added to stabilize the emulsion. The emulsion was divided up.

Latent image stabilizers were added to various portions of the emulsion in accordance with Table 1, tests 1 to 8. These portions were each brought to a gelatine content of 221 g gelatine/mol Ag by addition of gelatine, adjusted to pH 6.7 and pAg 9.0, applied to a transparent layer support (silver applied 32 mmol Ag/$m^2$) and hardened by means of a protective layer.

The film samples were exposed in a sensitometer behind a $\sqrt[3]{2}$ grey step wedge and developed for 16 minutes at 20° C. in a commercial black-and-white developer (Refinal). To determine storage behavior, one sample was processed fresh (=unstored, within 6 hours of exposure); a second sample was exposed, stored for 14 days at 57° C./35% relative humidity and then processed; a third sample was stored for 14 days at 57° C./35% relative humidity before exposure, exposed and then processed within 6 hours of exposure. Table 1 shows that, although compounds A-3, A-4, A-23 and B-8 individually have a more or less stabilizing effect on the latent image, they clearly reduce the sensitivity of the fresh material. If the latent image is stabilized with two compounds of which one belongs to class A and the other to class B, sensitivity is always higher although the total quantity of latent image stabilizer per mol silver halide (namely 600 μmol/mol Ag) was not changed.

EXAMPLE 2

The tests shown in Table 2 were carried out with the emulsion of Example I using a compound of class C.

Latent image stabilization with combinations of a compound from each of classes A and C is always characterized by higher sensitivity than latent image stabilization with the compounds of class A alone, as shown by a comparison with Table 1. Latent image stabilization with C-4 alone is weaker than with latent image stabilization with A-3, A-4, A-23 or B-8 alone and, at the same time, leads to higher fogging.

The three-component combination of a compound from each of classes A, B and C provides somewhat higher sensitivities than the two-component combination with no effect on latent image stabilization.

EXAMPLE 3

The results shown in Table 3 are obtained with a compound of class D and the emulsion described in Example 1. As in Example 2, it was found to be of advantage to use combinations of compounds from two different classes (A+D or B+D) or from three different classes (A+B+D) for latent image stabilization rather than a single latent-image-stabilizing compound.

TABLE 1

| Test No. | 1 | 2 | 3 | 4 | 5 | 6 | 7 | 8 |
|---|---|---|---|---|---|---|---|---|
| Purpose of test (Comparison, Invention) | comparison | comparison | comparison | comparison | comparison | invention | invention | invention |
| | | | μmol stabilizer/mol silver halide | | | | | |
| Stabilizer A-3 | — | 600 | — | — | — | 300 | — | — |
| A-4 | — | — | 600 | — | — | — | 300 | — |
| A-23 | — | — | — | 600 | — | — | — | 300 |
| B-8 | — | — | — | — | 600 | 300 | 300 | 300 |
| C-4 | — | — | — | — | — | — | — | — |
| D-5 | — | — | — | — | — | — | — | — |
| Sensitivity S (fresh) | 45.2 | 42.3 | 44.0 | 42.6 | 44.3 | 44.6 | 44.9 | 44.7 |
| Fogging F (fresh) | 0.09 | 0.09 | 0.04 | 0.03 | 0.03 | 0.04 | 0.04 | 0.04 |
| ΔS (stored after exposure) | −3.8 | +0.2 | −1.8 | −0.8 | −2.1 | 0.0 | −0.7 | −0.8 |
| ΔF (stored after exposure) | +0.01 | 0.00 | 0.00 | 0.00 | 0.00 | 0.00 | 0.00 | 0.00 |
| ΔS (stored before exposure) | −0.4 | +0.3 | +0.3 | −0.4 | −0.3 | +0.3 | 0.0 | −0.1 |
| ΔF (stored before exposure) | +0.01 | 0.00 | 0.00 | 0.00 | 0.00 | 0.00 | 0.00 | 0.00 |

TABLE 2

| Test No. | 9 | 10 | 11 | 12 | 13 | 14 | 15 | 16 |
|---|---|---|---|---|---|---|---|---|
| Purpose of test (Comparison, Invention) | comparison | invention | invention | invention | invention | invention | invention | invention |
| | | | μmol stabilizer/mol silver halide | | | | | |
| Stabilizer A-3 | — | 600 | — | — | — | 300 | — | — |
| A-4 | — | — | 600 | — | — | — | 300 | — |
| A-23 | — | — | — | 600 | — | — | — | 300 |
| B-8 | — | — | — | — | 600 | 300 | 300 | 300 |
| C-4 | 13 | 13 | 13 | 13 | 13 | 13 | 13 | 13 |
| D-5 | — | — | — | — | — | — | — | — |
| Sensitivity S (fresh) | 44.6 | 43.2 | 44.6 | 43.0 | 45.1 | 45.3 | 45.5 | 45.3 |
| Fogging F (fresh) | 0.15 | 0.04 | 0.06 | 0.06 | 0.05 | 0.05 | 0.05 | 0.07 |
| ΔS (stored after exposure) | −2.5 | +0.9 | −0.6 | 0.0 | −1.7 | +0.6 | +0.4 | −0.7 |
| ΔF (stored after exposure) | +0.08 | +0.04 | +0.06 | +0.05 | +0.04 | +0.05 | +0.05 | +0.06 |
| ΔS (stored before exposure) | +0.7 | +0.3 | +0.2 | −0.2 | 0 | −0.1 | −0.3 | −0.3 |
| ΔF (stored before exposure) | +0.09 | +0.04 | +0.06 | +0.06 | +0.03 | +0.06 | +0.07 | +0.06 |

TABLE 3

| Test No. | 17 | 18 | 19 | 20 | 21 | 22 | 23 | 24 |
|---|---|---|---|---|---|---|---|---|
| Purpose of test (Comparison, Invention) | comparison | invention | invention | invention | invention | invention | invention | invention |
| | | | μmol stabilizer/mol silver halide | | | | | |
| Stabilizer A-3 | — | 600 | — | — | — | 300 | — | — |
| A-4 | — | — | 600 | — | — | — | 300 | — |
| A-23 | — | — | — | 600 | — | — | — | 300 |
| B-8 | — | — | — | — | 600 | 300 | 300 | 300 |
| C-4 | — | — | — | — | — | — | — | — |
| D-5 | 18 | 18 | 18 | 18 | 18 | 18 | 18 | 18 |
| Sensitivity S (fresh) | 44.7 | 43.3 | 44.6 | 43.3 | 45.0 | 45.0 | 45.5 | 45.2 |
| Fogging F (fresh) | 0.16 | 0.04 | 0.06 | 0.06 | 0.06 | 0.05 | 0.05 | 0.06 |
| ΔS (stored after exposure) | −2.4 | +1.2 | −0.5 | +0.6 | −1.6 | +0.8 | +0.3 | −0.3 |
| ΔF (stored after exposure) | +0.09 | +0.06 | +0.07 | +0.05 | +0.05 | +0.05 | +0.05 | +0.07 |
| ΔS (stored before exposure) | −0.5 | +0.3 | +0.2 | −0.3 | +0.3 | +0.2 | +0.1 | −0.2 |
| ΔF (stored before exposure) | +0.10 | +0.06 | +0.06 | +0.06 | +0.06 | +0.06 | +0.06 | +0.07 |

We claim:

1. A photosensitive silver halide material comprising a support and at least one photosensitive silver halide emulsion layer of which the emulsion contains $10^{-5}$ to $10^{-2}$ mol per mol of silver halide of a compound corresponding to the general formula B:

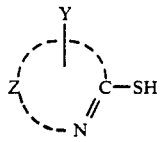

or tautomers thereof, in which

Z represents the atoms required to complete an oxazole or oxazine ring, and

Y represents a fused aromtic ring system comprising at lest one aromatic ring substituted by at least one acidic group, and $10^{-5}$ to $10^{-2}$ mol per mol of silver halide of a compound corresponding to the general formula A:

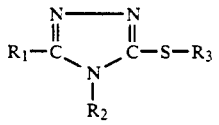

in which $R_1$ is hydrogen, alkyl containing up to 9 carbon atoms which may be substituted, aryl, aralkyl, cycloalkyl or a heterocycle, $R_2$ represents hydrogen, alkyl which may be substituted or unsubstituted, alkenyl, aryl or $—NR_4R_5$, $R_3$ represents hydrogen or a group releasable during development, $R_4$ and $R_5$ have the same meaning as $R_1$ or represent $—COR_6$, $—CONHR_7$ or $—COOR_8$, $R_6$ represents alkyl or cycloalkyl containing up to 8 carbon atoms which may be substituted or unsubstituted, $R_7$ represents hydrogen or $R_6$, $R_8$, $R_9$ and $R_{10}$ represent alkyl or cycloalkyl, which may be substituted or unsubstituted, containing up to 8 carbon atoms or aryl, such as phenyl;

and $10^{-6}$ to $10^{-3}$ mol per mol of silver halide of one compound selected from the group consisting of the classes C and D defined hereinafter:

C) compounds corresponding to the general formula

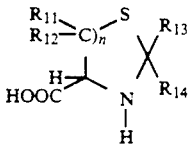

$R_{11}$ and $R_{12}$ may be the same or different and represent hydrogen or $C_{1-3}$ alkyl, $R_{13}$ and $R_{14}$ may be the same or different and represent hydrogen, cyclohexyl, aryl, a heterocycle, carbonyl or carbonamido, and n=1 or 2, and D) compounds corresponding to the general formula

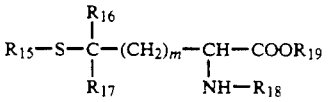

in which $R_{15}$ represents hydrogen, $C_{1-8}$ alkyl, which may be substituted or unsubstituted, allyl, benzyl, a group corresponding to the formula $—COR_{20}$, $—COOR_{21}$, or

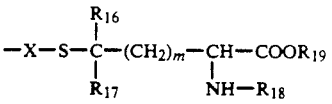

$R_{16}$ and $R_{17}$ represent $C_{1-3}$ alkyl, $R_{18}$ represents hydrogen, $—COR_{22}$, $CONHR_{23}$, $R_{19}$ represents hydrogen, $C_{1-10}$ alkyl, $R_{20}$, $R_{21}$ and $R_{22}$ represent alkyl or cycloalkyl containing up to 8 carbon atoms, which may be substituted, benzyl, alkyl or aryl, $R_{23}$ is hydrogen or $R_{20}$, X is direct bond or alkylene containing up to 6 carbon atoms, and m=0 or 1.

2. A photosensitive silver halide material as claimed in claim 1, in which in the compounds A $R_1$ hydrogen, $C_{1-9}$ alkyl, unsubstituted or substituted by $C_{1-4}$ alkoxy, carboxy, hydroxy, halogen, $C_{1-4}$ alkoxycarbonyl, $C_{1-4}$ alkyl carbonyloxy or phenoxy; phenyl unsubstituted or substituted by $C_{1-4}$ alkyl, $C_{1-4}$ alkoxy or halogen; cyclohexyl, benzyl, pyridyl or furyl, $R_2$ hydrogen, $C_{1-4}$ alkyl optionally substituted by carboxy, $C_{1-4}$ alkoxycarbonyl or 1-piperidino; allyl, phenyl or —$NR_4R_5$, $R_3$ hydrogen, $C_{1-4}$ alkylcarbonyl or $C_{1-6}$ alkoxycarbonyl, $R_4$ hydrogen, $C_{1-4}$ alkylcarbonyl, hydroxyethyl, $C_{1-4}$ alkylaminocarbonyl, cyclohexylaminocarbonyl, sulfophenyl, sulfophenylcarbonyl, methyl mercaptoacetyl or $C_{1-4}$ alkoxycarbonyl, $R_5$ hydrogen, $C_{1-4}$ alkylcarbcnyl or $C_{1-4}$ alkoxycarbonyl:

the compounds B correspond to the formula

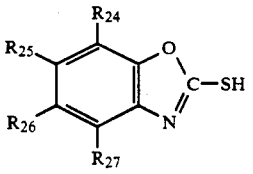

(V)

in which $R_{24}$ to $R_{27}$ may be the same or different and represent hydrogen or alkyl; two of the substituents $R_{24}$ to $R_{27}$ together may represent the atoms required to complete a ring, with the proviso that at least one of the substituents $R_{24}$ to $R_{27}$ contains an acidic substituent or is an acidic substituent;

in the compounds C, $R_{11}$ and $R_{12}$ independently of one another represent hydrogen or methyl, $R_{13}$ represents hydrogen or methyl, $R_{14}$ represents hydrogen, methyl, furyl, methyl furyl, thienyl, bromothienyl, cyclohexyl, phenyl, carboxy or aminocarbonyl, n=1 or 2;

in the compounds D, $R_{15}$ represents hydrogen, $C_{1-4}$ alkyl, carboxy-$C_{1-4}$-alkyl, allyl, $C_{1-4}$ alkoxycarbonyl, benzyl or $$X-S-CH_2-\underset{\underset{NH_2}{|}}{CH}-COOH,$$

$R_{16}$ represents hydrogen, $R_{17}$ represents hydrogen or methyl, $R_{18}$ represents $C_{1-4}$ alkylcarbonyl, aminocarbonyl, $R_{19}$ represents hydrogen or $C_{1-10}$ alkyl, X represents a direct bond or $C_{2-4}$ alkylene and m=0 or 1.

3. A photosensitive silver halide material as claimed in claim 1, characterized in that it is a color photographic silver halide material comprising a support, at least one red-sensitive layer with which a cyan coupler is associated, at least one green-sensitive layer with which a magenta coupler is associated and at least one blue-sensitive layer with which a yellow coupler is associated.

* * * * *